US009731536B2

(12) United States Patent
Osada et al.

(10) Patent No.: US 9,731,536 B2
(45) **Date of Patent: *Aug. 15, 2017**

(54) SHEET PROCESSING APPARATUS WITH STAPLING, FOLDING, AND ADHESION UNIT

(71) Applicant: NISCA CORPORATION, Minamikoma-gun, Yamanashi-ken (JP)

(72) Inventors: Hisashi Osada, Yamanashi-ken (JP); Takashi Saito, Yamanashi-ken (JP); Isao Kondo, Yamanashi-ken (JP)

(73) Assignee: NISCA CORPORATION, Minamikoma-Gun, Yamanashi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/850,413

(22) Filed: Sep. 10, 2015

(65) Prior Publication Data

US 2016/0089922 A1 Mar. 31, 2016

(30) Foreign Application Priority Data

Sep. 25, 2014 (JP) ..... 2014-194872

(51) Int. Cl.
*B42C 1/12* (2006.01)
*B65H 37/04* (2006.01)
(Continued)

(52) U.S. Cl.
CPC ..... *B42C 1/12* (2013.01); *B65H 31/02* (2013.01); *B65H 31/38* (2013.01); *B65H 37/04* (2013.01);
(Continued)

(58) Field of Classification Search
CPC ..... B42C 9/0081; B42C 19/02; B42C 1/12; B42C 1/00; B42C 9/0062; B42C 9/0068;
(Continued)

(56) References Cited

U.S. PATENT DOCUMENTS

| | | | | |
|---|---|---|---|---|
| 4,540,458 | A * | 9/1985 | Baughman | B42C 1/12 156/295 |
| 4,611,741 | A * | 9/1986 | Wilson | B42C 1/12 227/99 |
| 6,474,387 | B1 * | 11/2002 | Shimao | B07C 5/02 156/364 |
| 6,616,135 | B1 * | 9/2003 | Shida | B42C 9/0006 156/364 |
| 6,845,978 | B2 * | 1/2005 | Silverbrook | B42C 1/12 270/58.12 |
| 9,346,648 | B2 * | 5/2016 | Osada | B65H 37/04 |
| 9,409,741 | B2 * | 8/2016 | Osada | B65H 37/04 |
| 2008/0080959 | A1 * | 4/2008 | Magata | G03B 27/32 412/33 |
| 2008/0224379 | A1 * | 9/2008 | McNamara | B65H 31/00 270/58.09 |
| 2008/0315489 | A1 * | 12/2008 | Iguchi | B42C 1/12 270/37 |
| 2011/0280625 | A1 * | 11/2011 | Kushida | B65H 45/18 399/122 |

(Continued)

FOREIGN PATENT DOCUMENTS

| | | |
|---|---|---|
| JP | 5168474 B2 | 3/2013 |
| JP | 5382597 B2 | 1/2014 |

*Primary Examiner* — Patrick Mackey
(74) *Attorney, Agent, or Firm* — Manabu Kanesaka

(57) ABSTRACT

A sheet folding apparatus includes a retract path that is positioned on the upstream side of a stacker section for collecting sheets and that branches off from a transport path to enable a sheet carried in the stacker section to be transported in a direction opposite to a carry-in direction, an adhesion unit that is positioned in a junction position of the transport path and the retract path to bond sheets by applying an adhesive, a staple binding unit that binds sheets collected in the stacker section with a staple, and a folding processing section that folds sheets bound with the unit. The retract path is a path for retracting an application position of the preceding sheet with the adhesive applied, in carrying a next sheet in the stacker section, and the staple binding unit is disposed in the stacker section between the adhesion unit and the folding processing section.

10 Claims, 17 Drawing Sheets

(51) Int. Cl.
*B65H 31/02* (2006.01)
*B65H 31/38* (2006.01)
*B65H 45/18* (2006.01)

(52) U.S. Cl.
CPC ..... *B65H 45/18* (2013.01); *B65H 2301/4213* (2013.01); *B65H 2301/42146* (2013.01); *B65H 2301/5113* (2013.01); *B65H 2301/5161* (2013.01); *B65H 2301/51611* (2013.01); *B65H 2404/63* (2013.01); *B65H 2404/693* (2013.01); *B65H 2408/121* (2013.01); *B65H 2801/27* (2013.01)

(58) Field of Classification Search
CPC ..... B42C 9/0075; B42C 1/125; B42C 9/0006; B42C 9/0056; B42B 4/00; B65H 37/04; B65H 37/06
USPC ..... 270/58.08, 58.12; 412/8, 37
See application file for complete search history.

(56) References Cited

U.S. PATENT DOCUMENTS

2012/0155944 A1* 6/2012 Matsue ..... B42C 1/12 399/408
2013/0133837 A1* 5/2013 Naraoka ..... B42C 19/02 156/443
2015/0174941 A1 6/2015 Osada et al.
2015/0175379 A1 6/2015 Osada et al.
2015/0210503 A1 7/2015 Osada et al.

* cited by examiner

SHEET PROCESSING APPARATUS WITH STAPLING, FOLDING, AND ADHESION UNIT

BACKGROUND OF THE INVENTION

1. Field of the Invention

The present invention relates to a processing apparatus for bonding sheets carried out of an image formation apparatus such as a copier and printer to be a bunch, and when necessary, folding this bunch in a predetermined folding position, and more specifically, to an apparatus for enabling both a sheet booklet bonded with an adhesive and a staple-bound sheet booklet to be prepared corresponding to a request.

2. Description of the Related Art

Generally, a processing apparatus has been known widely which collates sheets carried out of an image formation apparatus to bind with a staple or fold in the shape of a booklet. Further, an apparatus is also disclosed which binds sheets with a staple, then folds the sheets in two to be a booklet, and bonds sheets with or adhesive to fold in two, as required.

For example, in Japanese Patent Gazette No. 5168474, a unit storage section is provided to enable a staple binding unit for performing staple binding on a bunch of sheets and an adhesive binding unit for performing gluing on sheets and press-binding to be a bunch of sheets to be selectively stored, and each of the units is set detachably so as to enable one of the staple binding unit and the adhesive binding unit to be inserted in the unit storage section.

Further, a folding processing section is shown which folds the sheets bound with one of the units in two.

Furthermore, Japanese Patent Gazette No. 5382597 shows an apparatus which is provided with two units of an adhesive binding unit for performing gluing on sheets and press-binding to be a bunch of sheets and a staple binding unit for performing staple binding, executes this unit selectively to perform fold processing, and which enables both the booklet by gluing and the booklet by staple binding to be prepared.

However, the apparatus as shown in above-mentioned Japanese Patent Gazette No. 5168474 enables one of the staple binding unit and the adhesive binding unit to be inserted in the unit storage section of the apparatus. Therefore, in the case of needing adhesive binding and in the case of needing staple binding, it is necessary to replace the staple binding unit and the adhesive binding unit every time, the replacement requires effort and time, and it is hard to change between adhesive binding and staple binding.

In this respect, in the apparatus as shown in Japanese Patent Gazette No. 5382597, since the adhesive binding unit and the staple binding unit are provided side by side along a sheet transport path, effort of replacement is not required unlike the apparatus of Japanese Patent Gazette No. 5168474. However, the adhesive binding unit and the staple binding unit are disposed in different apparatus frames, and the apparatus is increased in size. In other words, since different regions are set for sheets to operate the adhesive binding unit and sheets of the staple binding unit, apparatus regions are required respectively corresponding to the sheet length. Further, in the apparatus of Japanese Patent Gazette No. 5382597, a next sheet is carried in with the gluing side of a preceding sheet exposed in gluing sheets, and therefore, sheets are sometimes bonded at a portion at which the sheets are originally not bonded. Furthermore, since the sheets are transported and guided to the folding apparatus by a distance two times or more the sheet length up to the folding apparatus after gluing, the adhesive sometimes adheres to the apparatus.

SUMMARY OF THE INVENTION

The present invention was made in view of the above-mentioned problems, enables sheets to be bonded in a predetermined position while preventing sheets from contacting an applied adhesive in an unexpected portion, by retracting an application position of a preceding sheet in carrying a next sheet in a stacker section, and also enables switching to staple binding from bonding of sheets to be performed corresponding to use without changing an apparatus. Further, it is an object of the invention to provide a compact sheet processing apparatus which enables two types of binding of bonding of sheets and staple binding to be performed with these schemes stored in a single apparatus frame, and an image formation apparatus adopting the sheet processing apparatus.

In order to attain the above-mentioned object, the present invention adopts the following configuration.

A sheet processing apparatus for folding sheets after binding is provided with a stacker section that collects sheets transported along a transport path, a sheet regulation member that regulates a sheet transported to the stacker section, a retract path that is positioned on the upstream side of the stacker section and that branches off from the transport path to enable a sheet carried in the stacker section to be transported in a direction opposite to a carry-in direction, an adhesion unit that is positioned in a junction position of the transport path and the retract path to bond sheets by applying an adhesive, a staple binding unit that binds the sheets collected in the stacker section with a staple, and a folding processing section that folds the sheets which are bonded in the adhesion unit or bound in the staple binding unit and collected in the stacker section, where the retract path is a path for retracting an application position of the preceding sheet with the adhesive applied, in carrying a next sheet in the stacker section, and the staple binding unit is disposed in the stacker section between the adhesion unit and the folding processing section.

According to the present invention, by retracting the application position of the preceding sheet in carrying the next sheet in the stacker section, it is possible to bond sheets in a predetermined position while preventing sheets from contacting the applied adhesive in an unexpected portion, and it is also possible to switch to staple binding from bonding of sheets corresponding to use without changing an apparatus. Further, it is possible to provide a compact sheet processing apparatus which enables two types of binding of bonding of sheets and staple binding to be performed with these units stored in a single apparatus frame, and an image formation apparatus adopting the sheet processing apparatus.

BRIEF DESCRIPTION OF THE DRAWINGS

FIG. 5A is a plan view of adhesive tape stampers, FIG. 5B illustrates an engagement state with a cam member for shifting stamper holders, and FIG. 5C is an explanatory view of the cam member;

FIG. 6A is an outside shape view, FIG. 6B is a view where the adhesive tape is wound around a reel, FIG. 6C is a view of a gear state before pressing the adhesive tape stamper, and FIG. 6D is a view of a gear state for pressing with the adhesive tape stamper;

FIG. 7A is a view where two stamper holders are in upward positions, FIG. 7B is a view where one of the stamper holders starts to move down, and FIG. 7C is an explanatory view of an operation state in which a sheet press presses a sheet;

FIG. 8A is a view where the second stamper holder also starts to move down, FIG. 8B is a view where the adhesive tape stamper of one of the stamper holders presses the adhesive to the sheet, and FIG. 8C is a view where both adhesive tape stampers of two stamper holders press the adhesive to the sheet to apply;

FIG. 11A illustrates a state in which a bunch of sheets is collected, FIG. 11B illustrates a state in which a folding blade inserts the bunch of sheets into folding rollers, FIG. 11C illustrates an initial state for folding with the folding rollers, and FIG. 11D is a state in which the bunch of sheets is folded with the folding rollers;

FIG. 12A illustrates a state in which a first sheet is carried in a carry-in path, FIG. 12B is a view illustrating a state in which a rear end of the first sheet passes through a branch point of the carry-in path and a retract path, and FIG. 12C illustrates a state in which the first sheet is transported to the retract path and the adhesive is applied to the surface;

FIG. 13A illustrates a state in which the adhesive application position of the first sheet shifts to the retract path to prepare for carry-in of a second sheet, FIG. 13B illustrates a state in which the center of the second sheet is bonded to the adhesive application position of the first sheet, and sheets are further transported to the stacker downstream side, and FIG. 13C is a view where the rear end of bonded sheets passes through the carry-in path and retract path and the sheet rear end is deflected to the retract path side with a deflecting gate;

FIG. 14A is a state view where the adhesive is applied to the second sheet, the application position is retracted to the retract path, and a third sheet is carried in, FIG. 14B is a view where bonded sheets in the retract path and the third sheet are aligned and carried in a stacker section, and FIG. 14C is a view illustrating a state in which the adhesive application position of bonded three sheets is transported to a folding processing position to perform folding processing;

FIG. 15A illustrates a state in which a first sheet is carried in the stacker section, FIG. 15B illustrates a state in which the rear end of the first sheet passes through the branch portion of the carry-in path and the retract path and is positioned on the retract path side with a deflecting guide, and FIG. 15C illustrates a state in which a second sheet is also carried in the stacker section;

FIG. 16A illustrates a state in which a third sheet is carried in the stacker section, FIG. 16B illustrates a state in which the center of three sheets is positioned in a position of the staple binding unit, and FIG. 16C is a view illustrating a state in which the position subjected to saddle stitching with metal staples is transported to the folding processing section to wait for folding processing.

DESCRIPTION OF THE EMBODIMENTS

Figure 1:
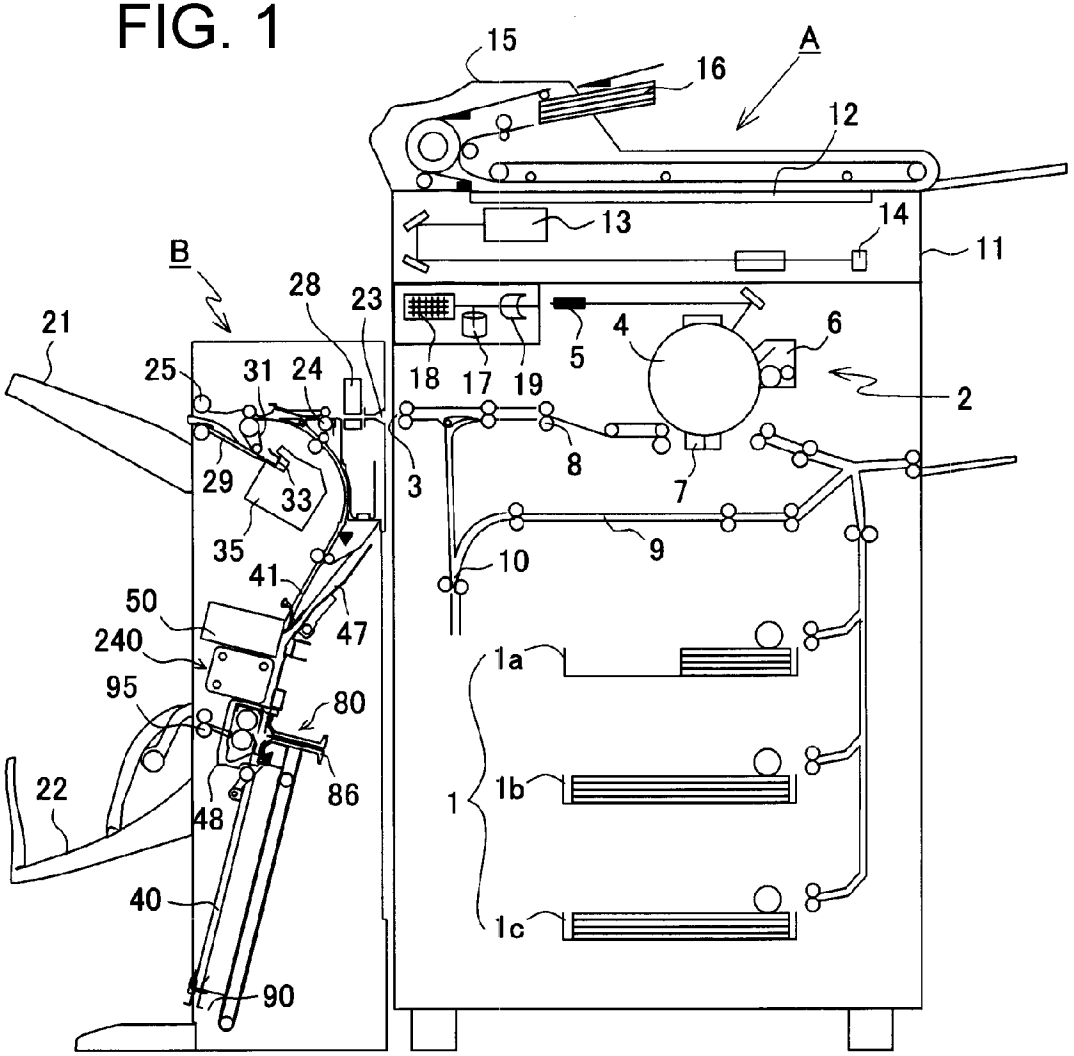
FIG. 1 is an explanatory view illustrating the entire configuration obtained by combining an image formation apparatus and sheet processing apparatus according to the present invention.
Figure 2:
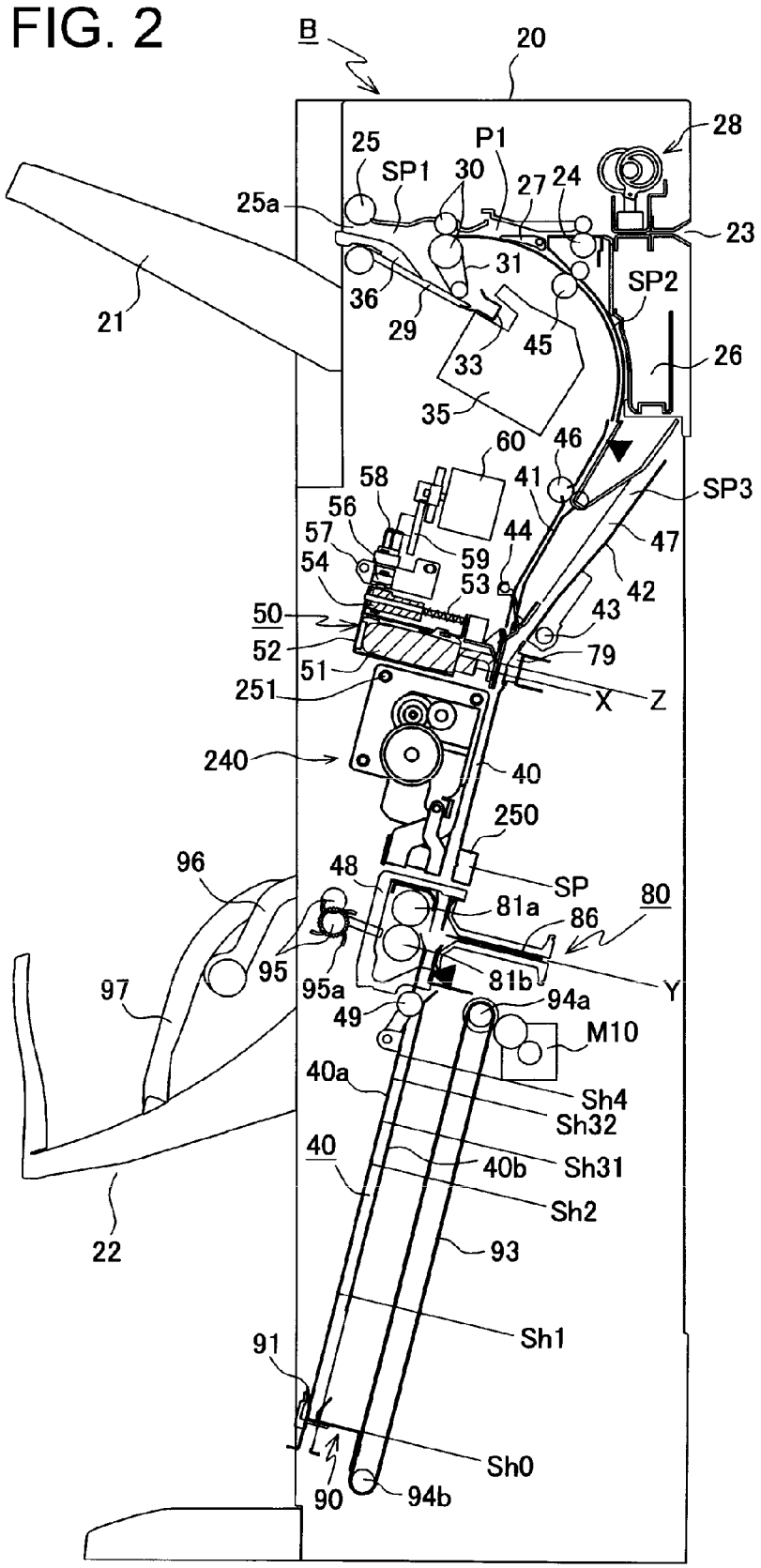
FIG. 2 is an entire explanatory view of the sheet processing apparatus provided with an adhesion unit and staple binding unit according to the invention.

The present invention will specifically be described below based on preferred Embodiments as shown in drawings. FIG. 1 illustrates the entire configuration obtained by combining an image formation apparatus and sheet processing apparatus according to the present invention, FIG. 2 is an explanatory view of the entire configuration of the sheet processing apparatus, and FIG. 3 and subsequent figures are explanatory views illustrating mechanism configurations of the sheet processing apparatus. Then, the apparatus as shown in FIG. 1 is comprised of the image formation apparatus A and sheet processing apparatus B, and into the sheet processing apparatus B are incorporated an adhesion unit 50 that applies an adhesive to the center in a sheet transport direction and a staple binding unit 240 that performs saddle stitching on the center in the sheet transport direction with staples respectively as a unit.

[Configuration of the Image Formation Apparatus]

The image formation apparatus A as shown in FIG. 1 feeds a sheet to an image formation section 2 from a paper feed section 1, prints on the sheet in the image formation section 2, and discharges the sheet from a main-body discharge outlet 3. The paper feed section 1 stores sheets of a plurality of sizes in paper cassettes 1*a*, 1*b* and 1*c*, and separates designated sheets on a sheet-by-sheet basis to feed to the image formation section 2. In the image formation section 2 are arranged, for example, an electrostatic drum 4, and a print head (laser emitter) 5, developing device 6, transfer charger 7 and fuser 8 disposed around the drum, an electrostatic latent image is formed on the electrostatic drum 4 with the laser emitter 5, the developing device 6 adds toner to the image, and the image is transferred onto the sheet with the transfer charger 7, and heated and fused with the fuser 8. The sheet with the image thus formed is sequentially carried out from the main-body discharge outlet 3. "9" shown in the figure denotes a circulating path, and is a path for two-sided printing for reversing the side of the sheet with printing on its frontside from the fuser 8 via a main-body switchback path 10, and feeding the sheet again to the image formation section 2 so as to print on the backside of the sheet. The side of thus two-sided printed sheet is reversed in the main-body switchback path 10, and then, the sheet is carried out from the main-body discharge outlet 3.

"11" shown in the figure denotes an image scanning apparatus, where an original document sheet set on an original document platen 12 is scanned with a scan unit 13, and is electrically read with a photoelectric conversion element 14 via reflecting mirrors and condenser lens. The image data is subjected to, for example, digital processing in an image processing section, and is then transferred to a data storing section 17, and an image signal is sent to the laser emitter 5. Further, "15" shown in the figure denotes an original document feeding apparatus, and is a feeder apparatus for feeding an original document sheet stored in a stack tray 16 to the original document platen 12.

The image formation apparatus A with the above-mentioned configuration is provided with a control section (controller), and from a control panel 18 are set image formation conditions such as, for example, sheet size designation, color/monochrome printing designation, number-of-printout-copy designation, one-sided/two-sided printing designation and scaling printing designation as printout conditions. On the other hand, it is configured that the image formation apparatus A stores image data read by the scan unit 13 or image data transferred from an external network in the data storing section 17, the image data is transferred to a buffer memory 19 from the data storing section 17, and that a data signal is sequentially output to the laser emitter 5 from the buffer memory 19.

A sheet processing condition is also input and designated from the control panel 18, concurrently with the image formation conditions. Designated as the sheet processing condition is, for example, a "printout mode", "staple binding mode", "adhesion sheet bunch folding mode", "staple saddle stitching sheet bunch folding mode" or the like. Then, the image formation apparatus A forms images on sheets corresponding to the image formation conditions and sheet processing condition.

[Configuration of the Sheet Processing Apparatus]

The sheet processing apparatus B coupled to the above-mentioned image formation apparatus A is configured to receive a sheet with the image formed thereon from the main-body discharge outlet 3 of the image formation apparatus A, and to 1. store the sheet in a first sheet discharge tray 21 ("printout mode" as described previously), 2. collate sheets from the main-body discharge outlet 3 in the shape of a bunch to perform staple binding, and then store in the first sheet discharge tray 21 ("staple binding mode" as described previously), 3. bond sheets from the main-body discharge outlet 3 on a sheet-by-sheet basis in the shape of a bunch, then fold in the shape of a booklet, and store in a second sheet discharge tray 22 ("adhesion sheet bunch folding mode" as described previously), or 4. collect sheets from the main-body discharge outlet 3 to collate, bind with staples, then fold in the shape of a booklet, and store in the second sheet discharge tray ("staple binding sheet bunch folding mode" as described previously).

Therefore, as shown in FIG. 2, the sheet processing apparatus B is provided with the first sheet discharge tray 21 and second sheet discharge tray 22 in a casing 20, and a sheet carry-in path P1 is provided which has a carry-in entrance 23 connected to the main-body discharge outlet 3. The sheet carry-in path P1 is comprised of a liner path substantially in a horizontal direction in the casing 20. Then, disposed are a first switchback transport path SP1 which branches off from the sheet carry-in path P1 to carry a sheet in a reverse direction, and a second switchback transport path SP2. Then, the first switchback transport path SP1 branches off from the sheet carry-in path P1 on the path downstream side, the second switchback transport path SP2 branches off from the sheet carry-in path P1 on the path upstream side, and both transport paths are disposed at a distance from each other.

In such a path configuration, in the sheet carry-in path P1 are disposed a carry-in roller 24 and sheet discharge roller 25, and these rollers are coupled to a forward/backward rotation-capable drive motor (M1). Further, in the sheet carry-in path P1 is disposed a path switching piece 27 for guiding a sheet to the second switchback transport path SP2, and the piece is coupled to an actuator such as a solenoid. Furthermore, in the sheet carry-in path P1, a punch unit (punching apparatus) 28 that makes a punch hole in the sheet from the carry-in entrance 23 is disposed on the downstream side of the carry-in roller 24. The punch unit 28 as shown in the figure is disposed on the upstream side of the carry-in roller 24 in the carry-in entrance 23 to be attachable/detachable in the casing 20 according to apparatus specifications. Further, below the punch unit 28, a punch waste box 26 that stores punch waste after punching is placed detachably from the casing 20.

[Configuration of the First Switchback Transport Path SP1]

The first switchback transport path SP1 disposed on the downstream side (apparatus rear end portion) of the sheet carry-in path P1 of FIG. 2 is configured as described below. In the sheet carry-path P1 are provided at its exit end the sheet discharge roller 25 and sheet discharge outlet 25*a*. A first processing tray (hereinafter, referred to as "processing tray 29") is provided below the sheet discharge outlet 25*a* while being spaced apart by a level difference. The processing tray 29 is comprised of a tray to load and support a sheet from the sheet discharge outlet 25*a*. A forward/backward rotation roller 30 is provided above the processing tray 29. The forward/backward rotation roller 30 is coupled to the forward/backward rotation motor M1, and is controlled to rotate in a clockwise direction as viewed in FIG. 2 when a sheet moves onto the processing tray 29, and rotate in a counterclockwise direction after the sheet rear end moves onto the tray. In the forward/backward rotation roller 30 is provided an up-and-down roller 31 that is coupled with a caterpillar belt to shift to a position in contact with the tray and a position separate from the tray. Accordingly, the first switchback transport path SP1 is configured above the first processing tray 29.

The first sheet discharge tray 21 is disposed on the downstream side of the first switchback transport path SP1, and is configured to support the front end side of a sheet guided to the first switchback transport path SP1 and the second switchback transport path SP2.

According to the above-mentioned configuration, the sheet from the sheet discharge outlet 25*a* moves onto the processing tray 29, and is carried toward the first sheet discharge tray 21 by the forward/backward rotation roller 30, and after the sheet rear end moving onto the processing tray 29 from the sheet discharger outlet 25*a*, by rotating the forward/backward rotation roller 30 backward (in the counterclockwise direction as viewed in FIG. 2), the sheet on the processing tray 29 is carried in an direction opposite to a sheet discharge direction. At this point, the up-and-down roller 31 coupled to the caterpillar belt switchback-transports the sheet rear end along the processing tray 29 in a position in contact with the tray in cooperation with the forward/backward rotation roller 30.

In a rear end portion in the sheet discharge direction of the first processing tray 29 are disposed a rear end regulation member 33 that regulates a position of the sheet rear end and end surface binding stapler 35. The end surface binding stapler 35 shown in FIG. 2 is comprised of the end surface binding stapler 35, and performs staple binding on a single portion or a plurality of portions of a rear end edge of a bunch of sheets collected on the tray. Further, the rear end regulation member 33 is configured to be able to reciprocate in the sheet discharge direction along the processing tray 29 so as to share the function of carrying out the bunch of staple-bound sheets to the first sheet discharge tray 21 disposed on the downstream side of the processing tray 29. The rear end regulation member 33 shown in FIG. 2 is coupled to a bunch sheet discharge motor (M7), not shown in the figure, to reciprocate.

Further, in the processing tray 29 are provided side aligning plates 36 that align the width direction of sheets collected on the tray, and the side aligning plates 36 are comprised of a pair of left and right (front and back in FIG. 2) aligning plates to align sheets in a center reference, are configured to move close and away to/from the sheet center, and are coupled to a side aligning plate motor (M6) not shown in the figure.

The first switchback transport path SP1 configured as described above is to collate sheets from the sheet discharge outlet 25*a* on the processing tray 29 in the "staple binding mode", and perform staple binding on a single portion or plurality of portions of the rear end edge of this bunch of sheets with the end surface binding stapler 35. On the other hand, in the "printout mode", the sheet from the sheet discharge outlet 25*a* is not subjected to switchback transport, and the sheet fed along the processing tray 29 is carried out to the first sheet discharge tray 21 by the forward/backward rotation roller 30. Thus, in the apparatus shown in the figure, sheets to undergo staple binding are bridge-supported by the processing tray 29 and the first sheet discharge tray 21, and the apparatus is thereby configured to be compact.

[Configuration of the Second Switchback Transport Path SP2]

Described is the configuration of the second switchback transport path SP2 branching off from the sheet carry-in path P1. As shown in FIG. 2, the second switchback transport path SP2 is disposed substantially in a perpendicular direction in the casing 20, a path carry-in roller 45 is disposed in a path entrance, and a transport roller 46 is disposed in a path exit. The transport roller 46 is configured to be able to move to a position for nipping a sheet and to a position separate from the sheet. This configuration is particularly not shown in the figure, and is to separate a pinch roller in press-contact with the transport roller 46 with an arm or the like.

The path carry-in roller 45 disposed in the path entrance of the second switchback transport path SP2 is configured to be able to rotate forward and backward, and temporality holds (leaves) a sheet, which is carried in the first switchback transport path SP1 on the downstream side, in the second switchback transport path SP2. This is because of collecting preceding sheets on the processing tray 29, performing staple binding with a job end signal, next temporarily holding a sheet, which is fed from the image formation apparatus A to the sheet carry-in path P1 for a period during which this bunch of sheets is carried out to the first sheet discharge tray 21, in the second switchback transport path SP2, and after finishing the processing of preceding sheets, transporting the waiting sheet from the first switchback transport path SP1 onto the processing tray 29.

Further, on the downstream side of a carry-in path 41 which is the second switchback transport path SP2, while being a transport path of sheet carry-in, a stacker section 40 is provided which constitutes a second processing tray for collating and temporarily collecting sheets fed from the path. The stacker section 40 shown in the figure is comprised of a transport guide for carrying the sheet. This transport guide is formed of a stacker upper guide 40*a* and a stacker lower guide 40*b*, and is configured to load and store sheets inside the guide. The stacker section 40 shown in the figure is connected to the carry-in path 41, and is disposed in the lateral center portion of the casing 20 substantially in the vertical direction. By this means, the apparatus is made small and compact. This stacker section 40 is formed in the shape of a length for storing maximum-size sheets inside the section. Further, inside the stacker section 40 are disposed the adhesion unit 50 as an adhesive application section that applies an adhesive to a sheet, the staple binding unit 240 that performs saddle stitching on the midpoint of sheets with staples, and a folding processing section 80 comprised of a folding blade 86 and folding rollers 81 to fold sheets. These configurations will be described later.

[Description of a Retract Path (Third Switchback Path SP3)]

Figure 3:
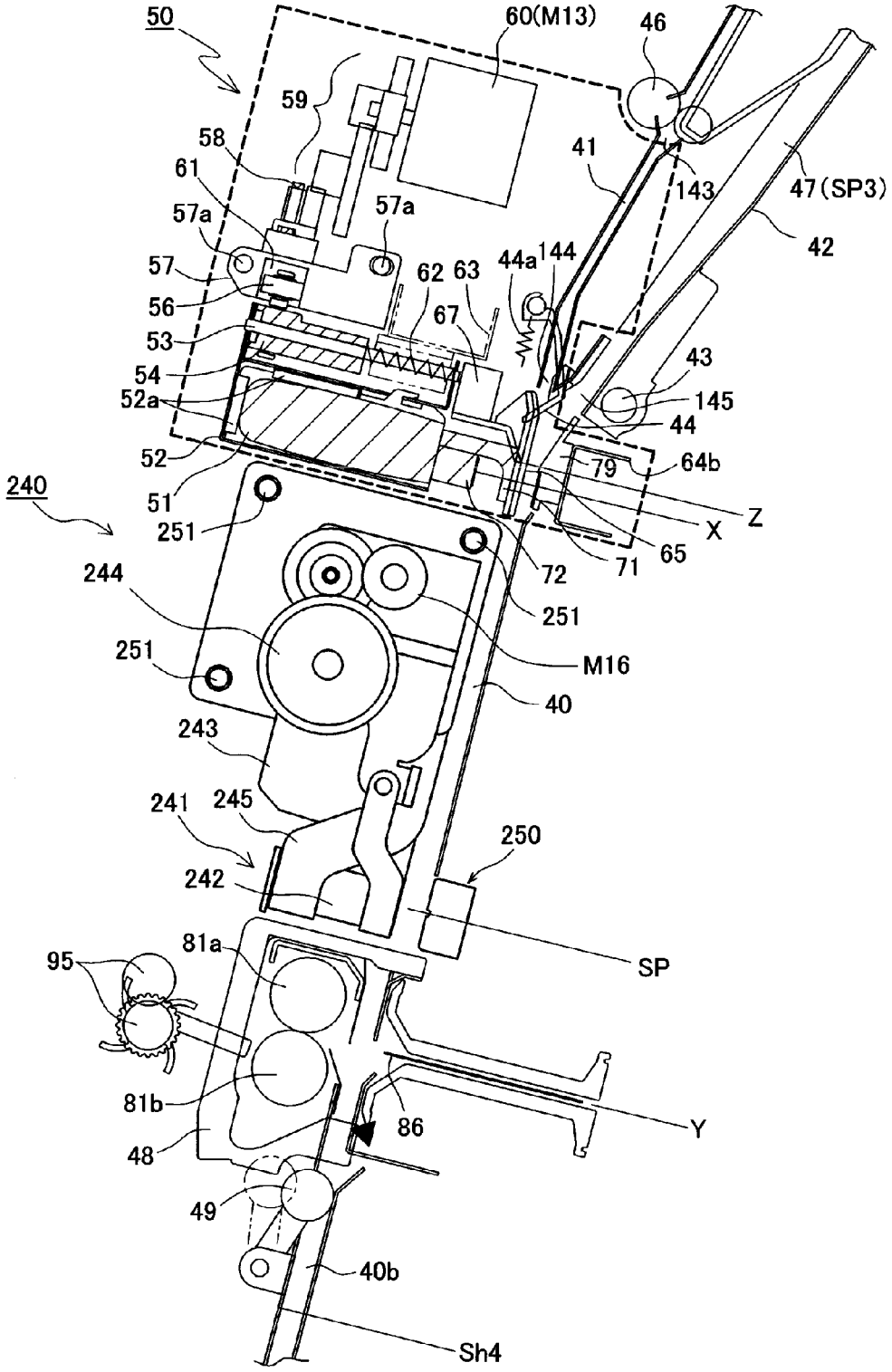
FIG. 3 is an explanatory view illustrating peripheral mechanisms of the adhesion unit and staple binding unit of FIG. 2.

To the rear end side in the transport direction of the stacker section 40 is connected a retract path 47 that is a third switchback path SP3 which branches off from the carry-in path 41 that is the second switchback transport path SP2 and that carries the sheet in the stacker section 40, and which overlaps with the carry-in path exist end to enable the sheet to undergo switchback transport. As shown in FIGS. 2 and 3, the retract path 47 is comprised of a switchback guide 42 made of a plate member. In the switchback guide 42, ribs protrude on the surface along the sheet transport direction to make transport of the sheet smooth. Further, the switchback guide 42 is configured to rotate about a guide release shaft 43 in a clockwise direction as viewed in the figure to enable release when a sheet bunch jam or the like occurs inside the retract path.

In switchback transport to the retract path 47, when the rear end of the sheet, which is carried in the stacker section 40 from the carry-in path 41, passes through the position for branching off from the carry-in path 41, the rear end side of the sheet is shifted (moved up) with a stopper section 90 as a sheet regulation member together with a bunch of sheets inside the stacker section 40, and is switchback-transported to the retract path 47.

In a junction position of the carry-in path 41 and the retract path 47 is provided a deflecting guide 44 biased to the switchback guide 42 side of the retract path 47 by a guide pulling spring 44*a*. Further, in the junction point, the adhesion unit 50 that applies the adhesive to the sheet is disposed immediately after the deflecting guide 44. The adhesion unit 50 is provided with adhesive tape stampers 51 as an adhesion section. Although a configuration of the adhesion unit 50 will be described later, when a next sheet is carried from the carry-in path 41 in this position after applying (transferring) the adhesive tape to a preceding sheet with the adhesive tape stamper 51 of this apparatus, the front end of the next sheet is bonded to the application portion of the preceding sheet, and it is not possible to apply the adhesive to the center portion in the transport direction constituting a bunch of sheets. Therefore, in order for the application portion of the adhesive of the preceding sheet not to interfere with carry-in of the sheet, the sheet is switchback-transported to the retract path 47, and then, the next sheet is transported to the adhesive tape stamper 51. Accordingly, this retract path 47 also functions as a path for retracting the adhesive-applied sheet.

[Outline of from the Retract Path to the Stopper Section]

Herein, based on FIGS. 2 and 3, the description will be given to the outline of the configuration of from the retract path 47 branching off from the carry-in path 41 to the stopper section 90.

First, in the junction point of the carry-in path 41 and the retract path 47 is provided the deflecting guide 44 with the spring placed in a tense state so as to lightly press the sheet to the switchback guide 42 side of the retract path 47 as described above. The deflecting guide 44 is set in the shape of comb teeth, while avoiding the application position of the adhesive to the sheet. Accordingly, when the adhesive-applied sheet passes below the deflecting guide 44, the adhesive does not adhere to the inside of the transport path. These flows of the sheet will be described separately.

In the junction point of the carry-in path 41 and the retract path 47 on the downstream side of the deflecting guide 44, as shown in FIG. 3 specifically, the adhesion unit 50 for applying the adhesive to the sheet is disposed inside the stacker section 40. To the adhesion unit 50 is attached a sheet press 65 capable of moving up and down to press the sheet halted in an adhesion position for bonding to regulate toward the stopper section 90. On the front end side of the sheet press 65 is disposed a sheet pressing slider 71 which holds the sheet down by moving up and down, while feeding out the adhesive tape AT as the adhesive. Above the sheet pressing slider 71 is provided a transfer head 72 for backing up the adhesive tape AT fed from a reel, and the transfer head 72 also shifts to the adhesion position for pressing the sheet to apply the adhesive tape AT to the sheet and a separate position separate from the sheet to allow the sheet to be transported and shifted.

In addition, the application in the present invention is assumed to include so-called the transfer for pressing the sheet to move the adhesive to the tape. Further, it is assumed to include spraying the adhesive or attaching a glue member while pressing the sheet.

On the downstream side of the adhesion unit 50 is disposed the staple binding unit 240 that is a saddle stitching stapler for performing binding saddle stitching processing with metal staples 239 that are metallic staples. The staple binding unit is to hammer the metal staple 239 into sheets in the center portion in the transport direction of a bunch of sheets collated and collected in the stacker section 40 in a staple binding position SP with a driver unit 241, and bend its legs to mutually oppose with a clincher unit 250 to bind the sheets. These configurations will be described later in FIGS. 9A and 9B.

In addition, in binding sheets with the staple binding unit 240, a bunch of sheets is once stored in the stacker section 40. In this case, when the rear end of the sheet, which is stored previously, is raised, the front end of the next sheet collides, and there is the case where it is not possible to insert in the stacker section 40 or the sheet moves into between stored sheets to cause the pages to get out of order. Therefore, in the apparatus of this Embodiment, the deflecting guide 44 as described previously biases the sheet to the retract path 47 side, and the next sheet is thereby loaded on the preceding sheet in orderly sequence. Further, in inserting the next sheet, by switching back a previous bunch of sheets every time, the preceding sheet surface guides the front end of the next sheet, and the next sheet is carried in the stacker section more smoothly.

On the downstream side of the staple binding unit is disposed an aligning member 48 that shifts in the width direction of the sheet to press the sheet side edges inside the stacker section 40. The aligning member 48 is approximately in the shape of a U, and in the center thereof, as the folding processing section, there are folding rollers 81*a*, 81*b* and folding blade 86 that presses the sheet to the folding rollers and that is capable of shifting to press and separate to/from the sheet. Immediately after the aligning member 48, a pressurizing roller 49 is provided to be able to separate so as to separate from and contact the stacker lower guide 40*b* that is one of guides constituting the stacker section 40. The pressurizing roller 49 is separate until the sheet front end passes the roller position, and when the sheet front end passes, rotates while pressing the sheet so as to press the sheet to the stacker lower guide 40*b*.

On the lower end side of the stacker section 40 is disposed the sheet regulation member (hereinafter, referred to stopper section 90) that regulates the front end in the carry-in direction of the sheet. The stopper section 90 is supported on a guide rail or the like of the apparatus frame to be able to shift along the stacker section 40, and is configured to be able to move up and down with an up-and-down belt 93 tightly provided between an upper pulley 94*a* and a lower pulley 94*b* positioned in the vertical direction. By shifting these pulleys 94 with a motor (M10), the up-and-down belt 93 is shifted. The up-and-down belt 93 halts in each position of Sh0, Sh1, Sh2, Sh31, Sh32, and Sh4 as described below and shifts.

First, Sh0 of the lowest end position is a home position of the stopper section 90, and this position is detected with a sensor (not shown) to set an initial position. Sh1 is a position for first receiving a sheet, and a position in which the rear end of sequentially piled sheets passes the carry-in path 41, and is pressed to the switchback guide 42 side of the retract path 47 by the deflecting guide 44. Sh2 is a position for performing folding processing on bunch-formed sheets in a ½ position in the sheet transport direction. Sh31 is a position in which the staple binding unit 240 hammers the metal staple 239 into sheets in the sheet width direction in an approximately ½ position in the transport direction of the sheet to bind. Sh32 is a position in which the adhesion unit 50 applies (transfers) the adhesive tape AT to the sheet in the sheet width direction in the approximately ½ position in the transport direction of the sheet. Sh4 is a position for shifting the application position of the sheet applied with the adhesion member to the retract path 47. This position is to enable the application position of the preceding sheet to retract to a position (application hiding position 100) away from the carry-in path of the next sheet, so as to prevent the next sheet from contacting the adhesive application position of the preceding sheet to prevent a paper jam from occurring or the adhesive from adhering to an unexpected position, in carrying the next sheet in the stacker section 40 from the carry-in path 41.

Further, in binding with the staple binding unit, a sheet may be positioned on the upstream side of Sh1 whenever the sheet moves to the stacker section 40 so as to enable the next sheet to be carried in while being guided on the preceding sheet.

As described above, the apparatus of this Embodiment is to repeat carry-in of a sheet, application of the adhesion to the sheet or staple binding, shift of the application position to the retract path, carry-in of a next sheet, and adhesive application to the next sheet, and thereby bond sheets with the adhesive to perform bunch formation. In addition, the bunch formation will later be described sequentially.

After the sheet bunch formation, the bunch of sheets is folded in two in the folding processing section 80, and the bunch of sheets folded in two is discharged to the second sheet discharge tray with a bunch sheet discharge roller 95 provided with a bunch kicking piece 95*a*. The discharged bunch of sheets is collected on the second tray with a bunch pressing guide 96 to prevent the bunch from opening to decrease a load range, and a bunch press 97 positioned on the downstream side thereof.

[Explanation of the Adhesion Unit]

Figure 4:
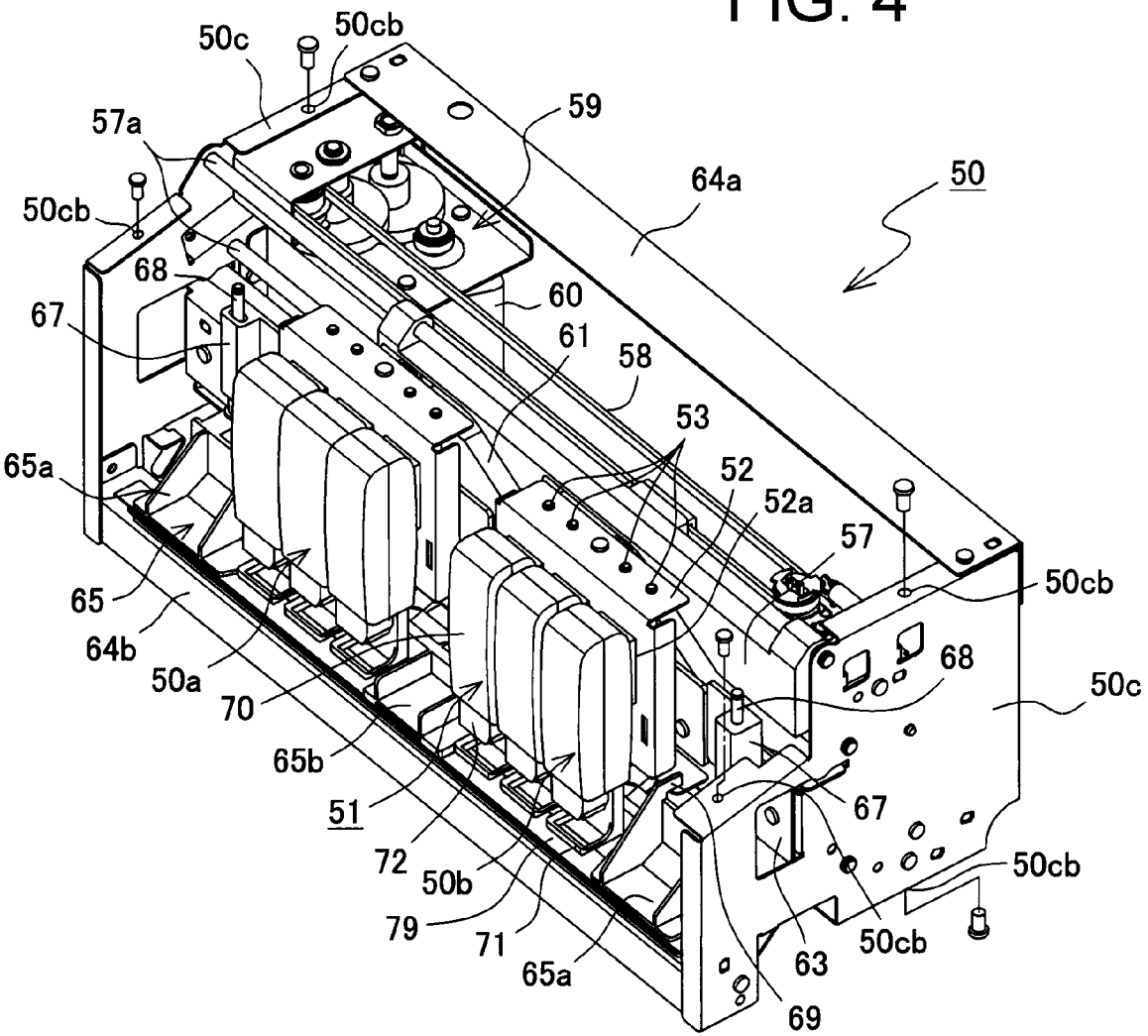
FIG. 4 is a perspective explanatory view of the adhesion unit of FIG. 2.
Figure 5A:
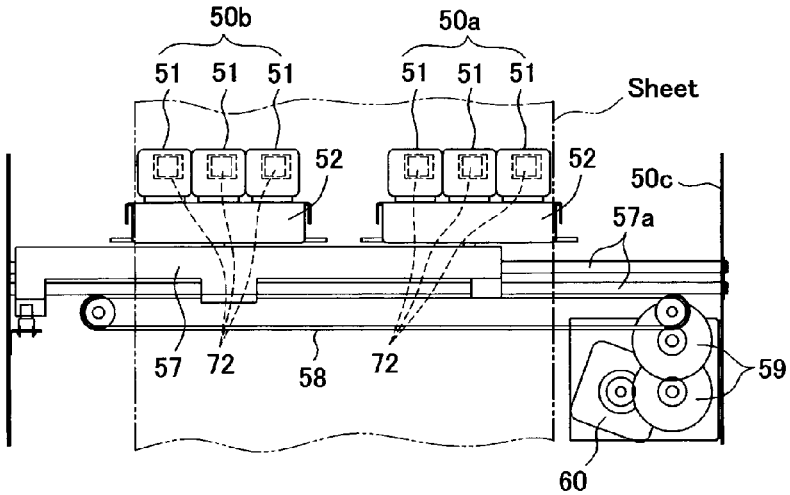
FIGS. 5A-5C contain views to explain the adhesion unit of FIG. 3, where
Figure 5B:
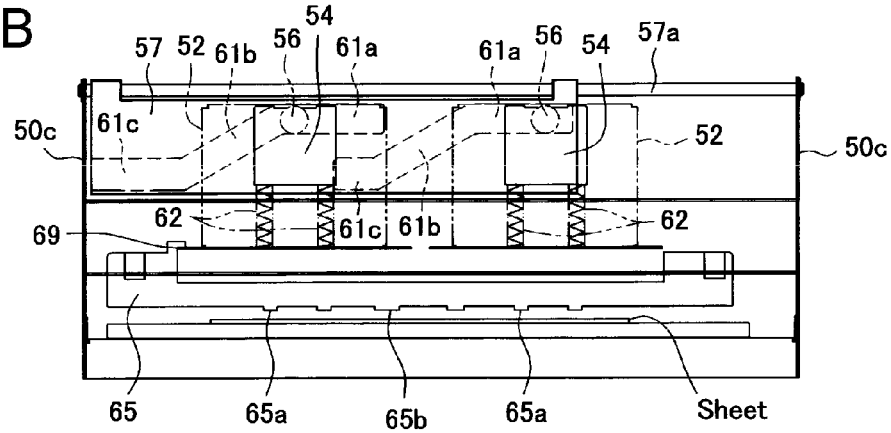
Figure 5C:
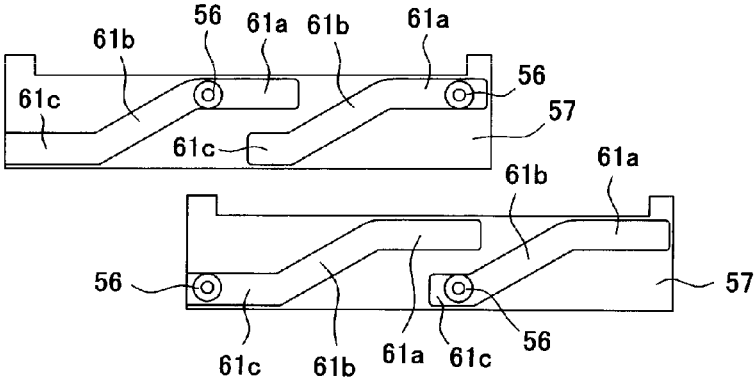
Figure 6A:
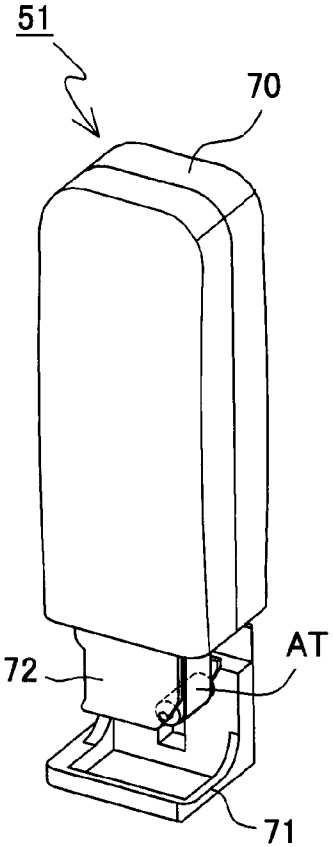
FIGS. 6A-6D contain explanatory views of an adhesive tape to apply an adhesive, where
Figure 6B:
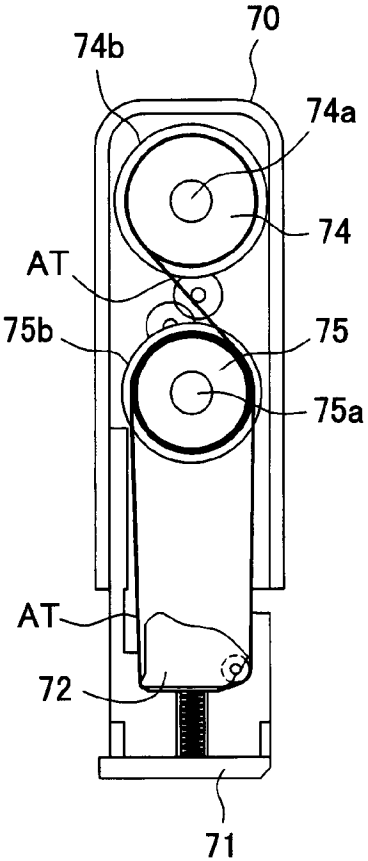
Figure 6C:
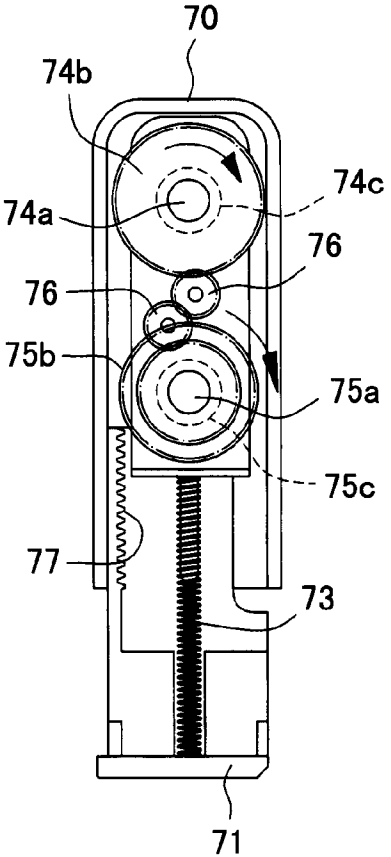
Figure 6D:
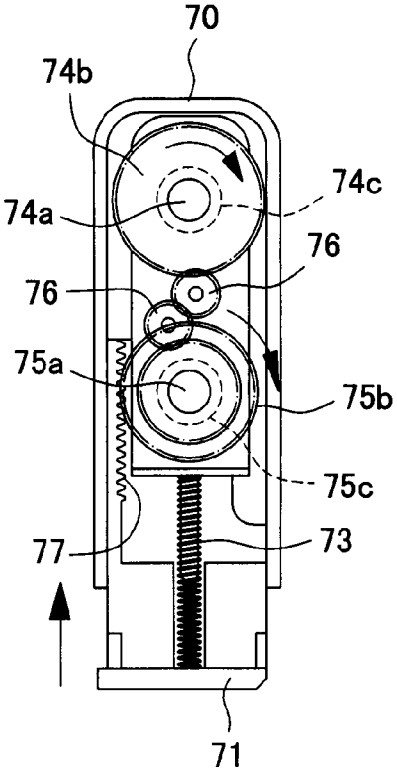

The adhesion unit 50 for performing application of the adhesive will be described next with reference to FIGS. 3 to 6D. A range enclosed with dashed lines in FIG. 3 is a cross-sectional explanatory view of the adhesion unit 50 in this Embodiment. FIG. 4 is a perspective view of the adhesion unit 50, and this apparatus range is inserted in the sheet processing apparatus B as a unit. FIGS. 5A-5C contain explanatory views of principal parts of adhesive tape units 50*a*, 50*b* as an adhesion section, FIG. 5A is a plan view of a cam member 57 and the like, FIG. 5B is a front view illustrating an engagement state of the cam member 57 and stamper holders 52, and FIG. 5C is an explanatory view of the cam member 57 where the upper stage illustrates a position in which the adhesive tape stamper 51 is separated from a sheet, and the lower stage illustrates the cam member 57 which shifts to a position for contacting the sheet and pressing the stamper holder 52 to the platen 79 side. FIGS. 6A-6D contain explanatory views of the adhesive tape stamper 51, FIG. 6A is a perspective view, FIG. 6B is a view of an internal mechanism, and FIGS. 6C and 6D are drive explanatory views for winding up the transfer tape AT by stamper operation. FIGS. 7A-7C and 8A-8C are operation explanatory views where the adhesive tape units 50*a*, 50*b* supporting a plurality of adhesive tape stampers 51 apply the adhesive tape AT to the sheet.

In the range of dashed lines of FIG. 3 are disposed the adhesive tape stampers 51 constituting the adhesion unit 50, the stamper holders 52 for grouping the adhesive tape stampers 51 to support in parallel, the cam member 57 for moving up and down the stamper holders 52 between the position for bringing the holder 52 close to the platen 79 so as to press the adhesive tape stamper 51 to the sheet to apply the adhesive to the sheet, and a position separate from the platen 79, and a cam shift motor 60 (M13) for shifting the cam member 57 in a direction crossing the transport direction of the sheet. Further, a plurality of adhesive tape units 50*a*, 50*b* is made a single unit as the adhesion unit 50, and is configured to enable the unit to be inserted in the sheet processing apparatus B, more specifically, in an upstream position of the stacker section 40. Further, in order for the sheet not to become misaligned in carrying the sheet in the stacker section 40 or switching back to the retract path 47, the adhesion unit 50 is to also install a part of the carry-in path 41 (more specifically, from a unit path entrance 143 to a carry-in path exit 144 as shown in FIG. 3), the deflecting guide 44, a part (more specifically, a retract path entrance 145) of the retract path 47 branching off, and the platen 79 inside the apparatus as this unit. These components are the adhesion unit 50 of the range enclosed with dashed lines in FIG. 3, and are illustrated in FIG. 4 as a perspective view.

Installation of the adhesion unit 50 into the sheet processing apparatus B is performed, as shown in FIG. 4, by securing fix portions, not shown, of the sheet processing apparatus B and set screw holes 50*cb* provided in the frame of the adhesion unit 50 with screws shown in the figure. In addition, instead of the screws, rails may be provided in each of the sheet processing apparatus B and the adhesion unit 50 to pull out.

By making the unit as described above, each position relationship is higher in accuracy than installing to the sheet processing apparatus B separately, and particularly, it is reduced that the adhesive adheres to a portion to which the adhesive is originally not expected to adhere, by misalignment, in shifting the adhesive-applied sheet.

The adhesion unit 50 is comprised of a single casing with right and left application apparatus frames 50*c*, a center support frame 63 for coupling the right and left application apparatus frames 50*c* at the center, a rear support frame 64*a* for coupling the frames in the rear, and a lower support frame 64*b* for coupling the frames below the platen 79. The cam shift motor 60 (M13) is installed in one of the application apparatus frames 50*c*. Drive of the cam shift motor 60 (M13) is transferred to a shift belt 58 via a gear line 59. This shift belt 58 is coupled to the cam member 57 slidable in the sheet width direction on two cam guide rods 57*a* between the right and left application apparatus frames 50*c*. Accordingly, by driving the cam shift motor 60 (M13), the cam member 57 shifts to the left and right corresponding to the rotation direction.

In addition, in the cam member 57 are formed cam grooves 61 as shown in FIGS. 5B and 5C. As shown in the figure, in the cam groove 61 are positioned an upper horizontal cam groove 61*a* provided on the upper side of the cam member 57, a lower horizontal cam groove 61*c* provided on the lower side, and an inclined cam groove 61*b* communicated with these grooves. As shown in the figure, two cam grooves 61 are formed at the left and right, and phases of these grooves are slightly different. In the cam grooves 61, rollers 56 as a cam follower are fitted into shift blocks 54 to move the stamper holders 52 up and down.

The roller fitted and engaged in the cam groove 61 is installed fixedly in the shift block 54 via a shaft. Herein, by referring to FIG. 7A (this figure is an explanatory view in viewing the cam member 57 shown in FIG. 4 from the back side), the shift block 54 is supported slidably on two inner guide rods 53 among four guide rods 53 extending vertically provided in the stamper holder 52 for supporting the adhesive tape stampers 51. On the other hand, each of two outer guide rods 53 is supported slidably by a support block 55 fixed to the center support frame 63 for coupling the right and left application apparatus frames 50*c*. Accordingly, the stamper holder 52 for supporting the adhesive tape stampers 51 is supported by the support blocks 55 in which the outer guide rods 53 slide.

On the other hand, in the center of the stamper holder 52, to two guide rods 53 are attached the shift block 54 slidably, and the shift block 54 is fixedly installed in the roller 56 engaging in the above-mentioned cam groove 61 as a cam follower. Further, on the bottom of the shift block 54 and backside 52*c* of the bottom 52*b* of the stamper holder 52, pressurizing springs 62 are wound around the center guide rods 53. The pressurizing springs 62 always bias the shift block 54 in a direction for pressing to the upper portion of the stamper holder 52. Accordingly, when the cam member 57 shifts and the roller 56 engaging in the cam groove 61 moves downward, a transfer head 72, described later, of the adhesive tape stamper 51 comes into contact with the sheet to halt moving-down of the stamper holder 52. Then, the pressurizing springs 62 are compressed between the bottom of the shift block 54 and the backside 52*c* of the bottom 52*b* of the stamper holder 52. By this means, by the elastic force of the pressurizing springs 62 compressed by the shift block 54, the transfer head 72 is pressed to the sheet more strongly, and it is possible to apply (transfer) the adhesive on the transfer tape AT to the sheet reliably.

Further, in the right and left cam grooves 61 into which are fitted the rollers 56 engaging in the cam grooves 61, as shown in FIG. 5C, phases are different from each other, and initial positions of the cam grooves 61 of the rollers 56 are also different from each other. Therefore, the roller 56 on the left side in the figure starts to move down earlier, and the roller 56 on the right side arrives at the lower horizontal cam groove 61 later. Therefore, the lower horizontal cam groove 61 on the left side is set to be longer than that on the right side. By this means, the adhesive tape unit 50*a* on the left side having the adhesive tape stampers 51 presses the sheet earlier than the adhesive tape unit 50*b* on the right side having the stampers 51, and then, the adhesive tape unit 50*b* on the right side presses the sheet later. This is because high pressing forces are required for both of the adhesive tape units 50*a*, 50*b* to press the sheet at the same time, it is thereby necessary to use a larger drive motor for the shift of the cam member 57, and by dispersing, it is possible to achieve miniaturization of the motor and weight reduction of the frame.

[Explanation of the Adhesion Section (Adhesive Tape Stamper)]

Herein, referring to FIGS. 6A-6D, described is the adhesive tape stamper 51 attachable/detachable to/from the stamper holder 52 constituting each of the adhesive tape units 50*a*, 50*b*. First, FIG. 6A illustrates the outside appearance, and shows a stamper cover 70, the transfer tape AT having the adhesive on a tape substrate to be fed sequentially, the transfer head 72 backing up to press the transfer tape AT to the sheet, and the sheet pressing slider 71 that is positioned to the side of the transfer head 72 and that is capable of moving up and down to shift between a position protruding from the transfer head 72 and a position retracted to the same position as the position of the transfer head 72. The sheet pressing slider 71 holds down the sheet under the sheet pressing slider 71 when the transfer head 72 moves down to apply and transfer the transfer tape AT to the sheet, and by this pressing operation, the transfer tape AT is fed out to feed a new transfer surface. Then, the surface is backup-pressed by the transfer head 72 to apply and transfer the adhesive to the sheet.

Described next is the configuration for feeding out the transfer tape AT by expansion and contraction of the sheet pressing slider 71. As shown in FIG. 6B, inside the stamper cover 70 are disposed a supply reel 74 around which is wound an unused transfer tape AT and which is rotatable on a supply reel shaft 74*a*, and a wind-up reel 75 which winds up the transfer tape AT that is fed out of the supply reel 74 and that is looped on the transfer head 72, and which is rotatable on a wind-up reel shaft 75*a*. FIG. 6C illustrates a state before the transfer tape AT is fed out of the supply reel 74, and a slider rack 77 made of resin is formed above the sheet pressing slider 71 which expands and contracts inside the stamper cover 70. This slider rack 77 is engaged in a gear rotating integrally with the wind-up reel 75. Further, the gear of the wind-up reel 75 meshes with a gear that rotates integrally with the supply reel 74 via inter-reel gears 76.

Further, a slider spring 73 is provided inside the sheet pressing slider 71, and always biases the sheet pressing slider 71 outward (lower side in FIGS. 6A-6D). Accordingly, when the adhesive tape stamper 51 is pressed down in a state of FIG. 6D from a state of FIG. 6C in which the sider spring 73 expands, the slider spring 73 contracts. Concurrently therewith, the slider rack 77 engages in a wind-up reel gear 75*b* of the wind-up reel 75 to rotate the wind-up reel 75 in a clockwise direction as viewed in the figure. Further, the wind-up reel gear 75*b* meshes with the inter-reel gear 76, and the other one of the inter-reel gears 76 meshes with a supply reel gear 74*b*. Accordingly, when the wind-up reel 75 rotates in a clockwise direction as viewed in the figure, the supply reel 74 also rotates, the adhesive tape AT is wound around the wind-up reel, while being fed from the supply reel, and a new adhesive surface is positioned in the transfer head 72.

Next, when the adhesive tape stamper 51 is moved up from the state of FIG. 6D, the slider spring 73 elastically recovers to press the sheet pressing slider 71 downward. At this point, the wind-up reel gear 75*b* meshes with the slider rack 77, and thereby rotates in a counterclockwise direction, and since a ratchet mechanism that transfers in one direction exists between the gear and the wind-up reel 75, the wind-up reel 75 is not rotated. Further, the inter-reel gear 76 meshing with the wind-up reel gear 75*b* and the supply reel gear 74*b* are also rotated in a counterclockwise direction, and since a ratchet mechanism that transfers in one direction exists also between the gear and the supply reel 74, the supply reel 74 is not rotated. By such a mechanism, only in the case of pressing the sheet pressing slider 72 down, the supply reel 74 and wind-up reel 75 are rotated, and a new adhesive surface of the adhesive tape AT is fed to the transfer head 72 and is positioned. In addition, in this Embodiment, the ratchet mechanism is particularly not shown in the figure, and a one-way clutch or the like which transfers rotation only in one direction may be adopted between each reel gear and the reel.

The shift from FIG. 6C to FIG. 6D in this Embodiment is performed by the stamper holder 52 supporting a plurality of adhesive tape stampers 51 in the sheet width direction being moved up and down by the cam member 57. This mechanism is as described above. In addition, as shown in FIG. 3, cushion members 52*a* made of foamed resin or the like to cushion the impact of up-and-down operation exist between the stamper holder 52 and the adhesive tape stamper 51 to support. By this means, application (transfer) is enhanced in the adhesive from the adhesive tape AT to the sheet.

In addition, the adhesive tape AT in this Embodiment has the adhesive on the tape substrate, and is configured so that the adhesive is transferred to the sheet by pressing the tape to the sheet.

[Explanation of the Sheet Bunch Press Adjacent to the Stamper Holder]

The sheet press 65 will be described next with reference to FIGS. 3 and 4 and particularly FIG. 7A. The sheet press 65 is to regulate a shift and flutter of the sheet, before the sheet pressing slider 71 of the adhesive tape stamper 51 as described in FIGS. 6A-6D presses the sheet to the platen 79 in the adhesion position.

As described already, in the adhesion unit 50 is installed the sheet press 65 capable of moving up and down to press and regulate the sheet halted in the adhesion position for adhesion toward the platen 79. As shown in FIG. 7A, sheet press support blocks 67, which slide-support sheet press guide rods 68 having the sheet press 65, are provided on opposite sides of two stamper holders 52 supporting the adhesive tape stampers 51. The sheet press support blocks 67 are fixedly installed in the center support frame 63 with screws or like in circle holes shown in the figure. Further, pressurizing springs 65*c* wound around the sheet press guide rods 68 are disposed in the sheet press support blocks 67 and the opposite side ends of the side edge press 65*a* of the sheet press 65.

Figure 7A:
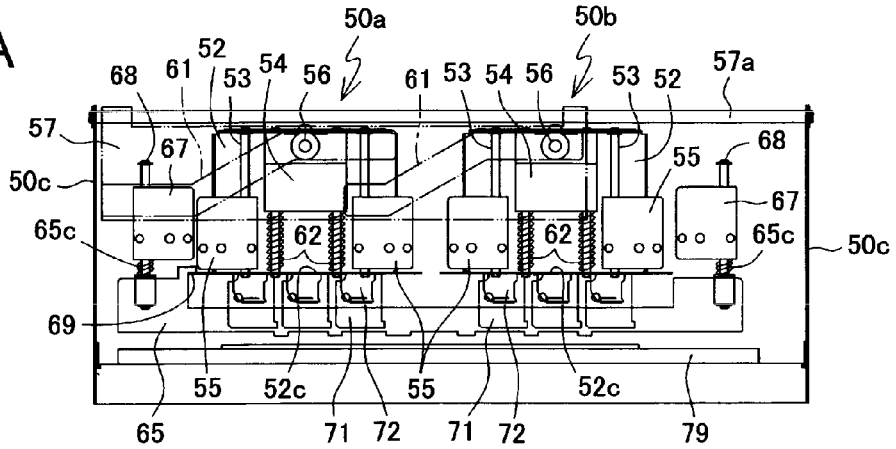
FIGS. 7A-7C contain views to explain operation of the stamper holders for applying the adhesive to a sheet, where

Further, the sheet bunch press 65 is always biased in a direction for pressing the sheet, and one (left side in FIGS. 7A-7C) of the stamper holders 52 and sheet press 65 are engaged in an engagement portion 69 to lock the sheet press 65 in a position separate from the sheet on the platen 79. Accordingly, when the stamper holder 52 does not move down by a shift of the cam member 57, the sheet press 65 is also halted in a position separate from the sheet to allow the sheet to be transported. When the stamper holder 52 starts to move down toward the sheet by a shift of the cam member 57, as shown in FIG. 7C, an engagement portion of the engagement portion 69 of the stamper holder 52 and the sheet press 65 moves down, and the sheet press 65 moves down to regulate so that misalignment or flutter does not occur on the sheet on the platen 79. By this regulation, at the time the stamper holder 52 further moves down and the sheet pressing slider 71 presses the sheet, and at the time the holder 52 further moves down and the transfer head 72 for supporting the adhesive tape AT to press to the sheet presses the sheet, it is possible to suppress misalignment and flutter of the sheet.

Figure 7B:
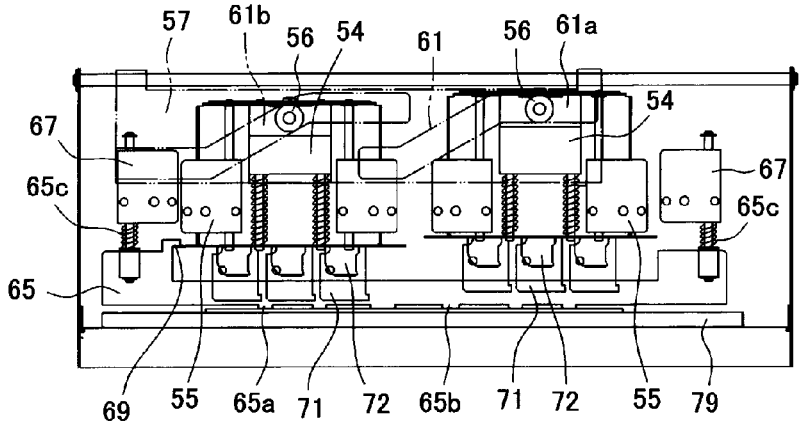
Figure 7C:
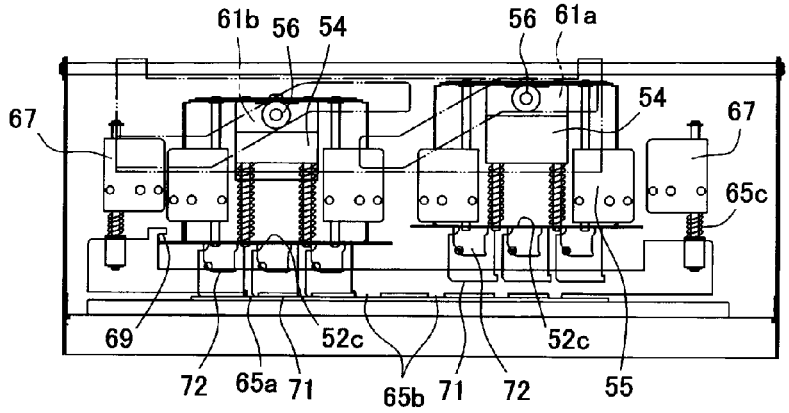

When application (transfer) of the adhesive of the adhesive tape AT by each of the adhesive tape stampers 51 in the sheet width direction is completed by descent of two stamper holders 52, the cam member returns to FIG. 7B at this point, the engagement portion of the sheet press 65 is engaged in the stamper holder 52, and the press moves up to a position retracted from the sheet by ascent of the stamper holder 52. As described above, the sheet press 65 in this Embodiment presses the sheet earlier than the other members in conjunction with descent/ascent of the stamper holder 52, and the sheet press may be shifted prior to descent of the stamper holder 52 with a solenoid or the like. Further, although the side edge press 65*a* and center press 65*b* are provided so as to press the entire sheet width region, only the side edge press 65*a* or only the center press 65*b* may be provided as necessary, and it is essential only that the sheet is prevented from shifting before application of the adhesive.

[Explanation of Operation of the Adhesion Unit]

Herein, operation for applying (transferring) the adhesive to the sheet with the adhesion unit 50 will be described with reference to FIGS. 7A-7C and 8A-8C. FIGS. 7A-7C and 8A-8C are explanatory views viewed from the backside of the cam member 57 on the side opposite to the adhesive tape stamper 51 in FIG. 4.

With the description given to the configuration as shown in FIG. 7A, the cam member 57 is in an initial position, the stamper holder 52 with the adhesive tape stampers 51 installed in the cam groove 61 of the cam member 57 is engaged in the shift block 54 sliding along the inner guide rods 53 and the roller 56. As described already, the pressurizing spring 62 exists between the shift block 54 and the stamper holder 52, and as shown in FIG. 7A, is pressed by the shift block 54 to come into contact with the backside 52*c* of the stamper holder 52. Further, in the support blocks 55 installed fixedly in the center support frame 63 for coupling the application apparatus frame 50*c* in the center, each stamper holder 52 is configured to slide on the outer guide rods 53 to be able to move up and down.

In FIG. 7A, the stamper holder 52 and sheet press 65 locked in the holder are separate from the platen 79, and maintain a clearance to enable the sheet to shift. In this state, the sheet pressing slider 71 and transfer head 72 of the adhesive tape stamper 51 are also in positions farthest from the sheet. The other stamper holder 52 is in the same position.

Next, in FIG. 7B, the sheet is positioned in the adhesion position, the cam shift motor 60 (M13) is driven with a signal for applying the adhesive tape AT, and the cam member 57 moves rightward as viewed in the figure. Then, the roller 56 on the left side in the figure starts to shift downward along the inclined cam groove 61*b*. By this shift, the left-side stamper holder 52 also moves down by the guide rods 53 sliding in the support blocks 55. By descent of the stamper holder 52, the engagement portion 69 locked therein also moves down, and starts to press the sheet on the platen 79. On the other hand, the sheet pressing slider 71 and transfer head 72 of the adhesive tape stamper 51 also move down, but do not contact the sheet. In the stamper holder 52 on the right side as viewed in the figure, since the roller 56 shifts only in a portion of the upper horizontal cam groove 61*a* of the cam groove 61, moving-down operation is not performed.

Further, when the cam member 57 shifts, as shown in FIG. 7C, the left-side roller 56 as viewed in the figure further moves down in the inclined cam groove. By this descent, released is lock of the engagement portion 69 between the sheet press 65 and the left-side stamper holder 52. When this lock is released, the sheet press 65 presses the sheet more reliably to regulate the position by the pressurizing spring 65*c* existing between the press 65 and the sheet press support block 67. On the other hand, the sheet pressing slider 71 of the adhesive tape stamper 51 starts to contact the sheet, and by this contact, as shown in FIGS. 6C and 6D, the adhesive tape AT also shifts to expose a new adhesive surface. Also in this position, the transfer head 72 does not come into contact with the sheet yet. Further, also in the stamper holder 52 on the right side as viewed in the figure, since the roller 56 shifts only in a portion of the upper horizontal cam groove 61*a* of the cam groove 61, moving-down operation is not performed.

Subsequently, as shown in 8A, when the cam member 57 shifts rightward as viewed in the figure, the stamper holder 52 on the left side as viewed in the figure moves down, and the sheet pressing slider 71 and transfer head 72 come into contact with the sheet. At this point, when the transfer head 72 comes into contact with the sheet, the stamper holder 52 stops further moving down, and the shift block 54 shifts in the inclined cam groove 61 to further move down. Then, by this shift, contraction of the pressurizing spring 62 is started, the elastic force acts as a pressurizing force of the transfer head 72 via the stamper holder 52, and the adhesive tape AT is pressed to the sheet more strongly. By this means, it is possible to apply and transfer the adhesive to the sheet reliably.

On the other hand, in the stamper holder 52 on the right side as viewed in the figure, the roller 56 also starts to move down in the inclined cam groove 61*b*, and the sheet pressing slider 71 of the right-side adhesive tape stamper 51 starts to press the sheet.

Figure 8A:
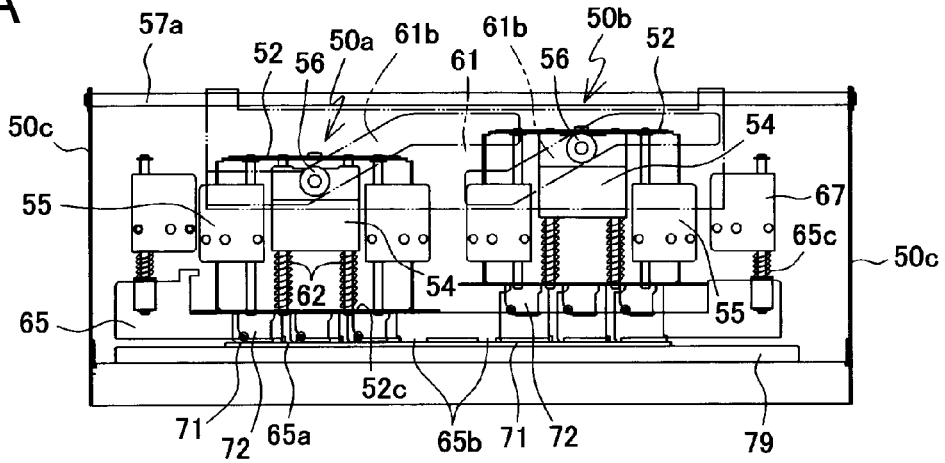
FIGS. 8A-8C contain views illustrating stamper holder operation states subsequent to FIGS. 7A-7C, where
Figure 8B:
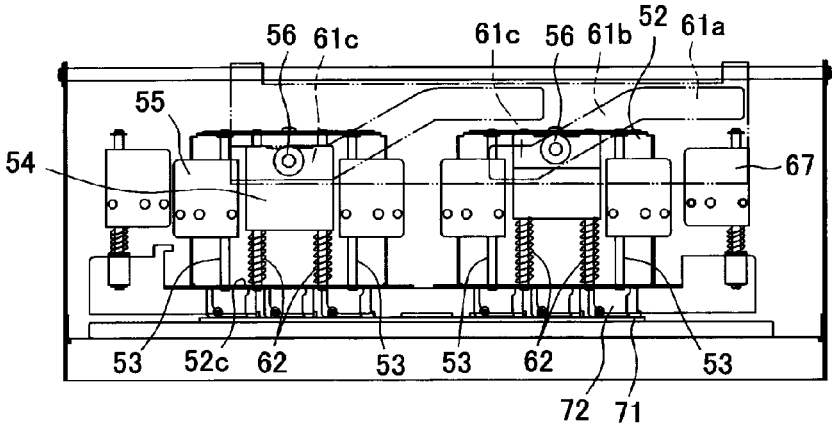

Further, the cam member 57 shifts and is in a state of FIG. 8B, the stamper holder 52 on the left side as viewed in the figure maintains the pressurizing state by the elastic force of the pressurizing spring 62. On the other hand, in the stamper holder 52 on the right side as viewed in the figure, the roller 56 also arrives at an end position of descent in the inclined cam groove 61*b*, and by this means, the sheet pressing slider 71 and transfer head 72 of the right-side adhesive tape stamper 51 are also in a state of pressing the sheet.

Figure 8C:
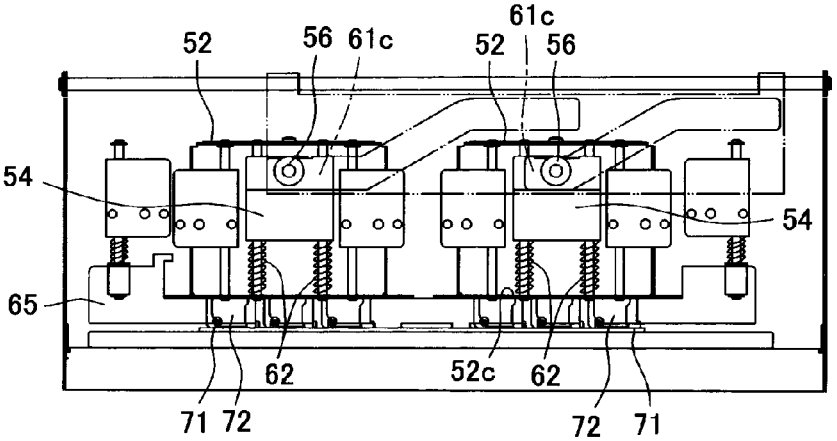

As shown in FIG. 8C, when the cam member 57 is positioned on the rightmost side, the stamper holder 52 on the left side as viewed in the figure is in a state for further maintaining the pressurizing state by the elastic force of the pressurizing sprint 62. On the other hand, the roller 56 of the stamper holder 52 on the right side as viewed in the figure also reaches the lower horizontal cam groove 61*c*. By this means, the sheet pressing slider 71 and transfer head 72 of the left-side adhesive tape stamper 51 press the sheet, the pressurizing spring 62 further contracts, the elastic force acts as a pressurizing force of the transfer head 72 via the stamper holder 52 on the right side as viewed in the figure, and the adhesive tape AT is pressed to the sheet more strongly. By this means, it is possible to apply (transfer) the adhesive to the sheet reliably. Further, when there is a preceding sheet with the adhesive applied, adhesion between sheets is reinforced.

When respective transfer heads 72 complete application of the adhesive to the sheet by descent of right and left stamper holders 52, at this point, the cam member 57 shifts to the left side as viewed in the figure to move up the stamper holders 52 in inverse order to descent. When the state reaches FIG. 7B, the left-side stamper holder 52 engages in the engagement portion 69 of the sheet press 65 to shift the sheet press 65 to a position separate from the sheet, and the member further returns to the state of FIG. 7A and prepares for application of the adhesive to a next sheet.

As described above, in the apparatus of this Embodiment, before the transfer head 72 of the adhesive tape stamper 51 applies the adhesive to a sheet, the sheet press 65 beforehand presses the sheet to regulate, and therefore, without misalignment or flutter of the sheet, it is possible to apply in a scheduled position on the sheet. Further, also after the transfer head 72 coming into contact with the sheet, the stamper holder 52 supporting the transfer head 72 is pressed by the pressurizing spring 62, it is thereby possible to press the transfer head 72 to the sheet more strongly, and it is possible to shift the adhesive on the adhesive tape AT to the sheet reliably.

Further, as described in the explanation of operation of the adhesion unit, the right and left stamper holders 52 shown in FIGS. 7A-7C and 8A-8C do not concurrently press the transfer heads 72 to the sheet, the left-side transfer head 72 group is first pressed to the sheet, while the cam member 57 maintains this state, the right-side transfer head 72 group is pressed to the sheet, and timing for sequentially pressing is thus shifted. Therefore, as compared with the apparatus for pressing at the same time, it is possible to reduce the driving force, and to decrease the size of the cam shift motor 60 (M13), and the apparatus is capable of being configured even when the apparatus frames are weak somewhat, and is reduced in weight.

Next, described sequentially are the staple binding unit 240 positioned on the downstream side of the adhesion unit 50 inside the stacker section 40, the aligning member 48, the transport roller 46 and pressurizing roller 49 separated from the sheet during the aligning operation, the stopper section 90 as a front end regulation member for regulating the front end of the sheet to carry in the stacker section 40, and a gripper 91 provided in the stopper section 90 to be able to grasp the sheet.

[Staple Binding Unit]

Described next is the staple binding unit 240 positioned on the downstream side of the adhesion unit 50 inside the stacker section 40. The staple binding unit 240 is a metal saddle stitching stapler for performing saddle stitching processing on the center of the sheet in the transport direction with the metal staple 239 in the stacker section 40. The configuration will be described based on FIGS. 9A and 9B. The staple binding unit 240 is comprised of driver units 241 and clincher unit 250. The driver unit 241 is comprised of a head member 242 for inserting the metal staple 239 in a bunch of sheets set in a binding position, a cartridge 243 for storing the metal staples 239, a driver cam 244, and a staple motor (M16) for driving the driver cam 244. In the driver unit 241, as shown in FIG. 9B, into the head member 242 are incorporated a driver member 246, former 247 and bending block 248 vertically in this order. Then, the driver member 246 and former 247 are supported by the head member 242 vertically slidably so as to reciprocate vertically between the top dead center and the bottom dead center, and the bending block 248 is fixed to the head member 242 as a forming block for bending the linear metal staple 239 in the shape of a U.

The clincher unit 250 is disposed in a position opposed to the driver units 241 with a bunch of sheets therebetween. The clincher unit 250 shown in the figure is comprised of a structure separated from the driver units 241, and bends needle tips of the metal staple 239 inserted in a bunch of sheets with the driver units 241. Therefore, the clincher unit 250 is provided with bending grooves 250*a* for bending the front ends of the metal staple 239. Particularly, in the clincher unit 250 shown in the figure, the bending grooves 250*a* are provided in two portions in the width direction of a bunch of sheets collected in the stacker section 40, and staple binding is performed in a plurality of portions in the sheet width direction with the driver units 241 that correspond to the positions.

Figure 9A:
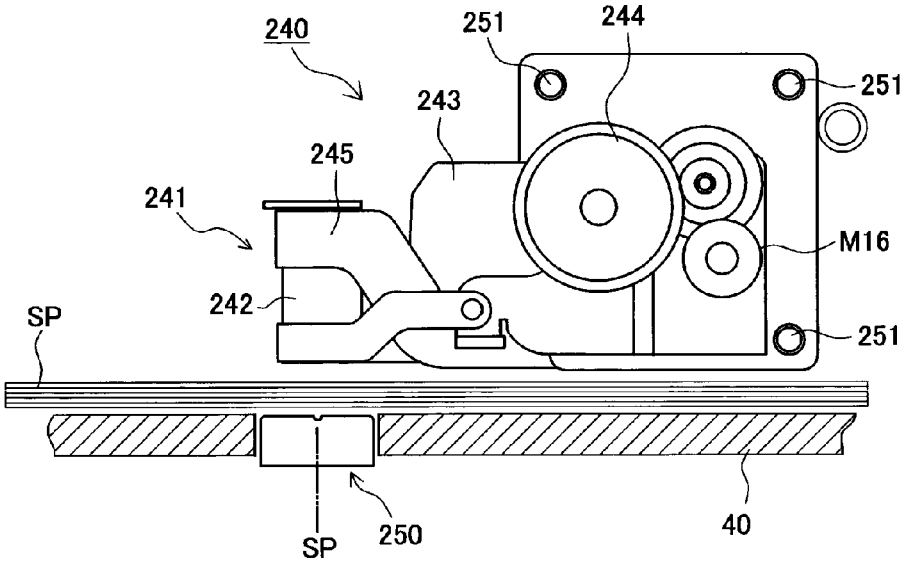
FIGS. 9A and 9B contain configuration views of the staple binding unit positioned on the downstream side of the adhesion unit.
Figure 9B:
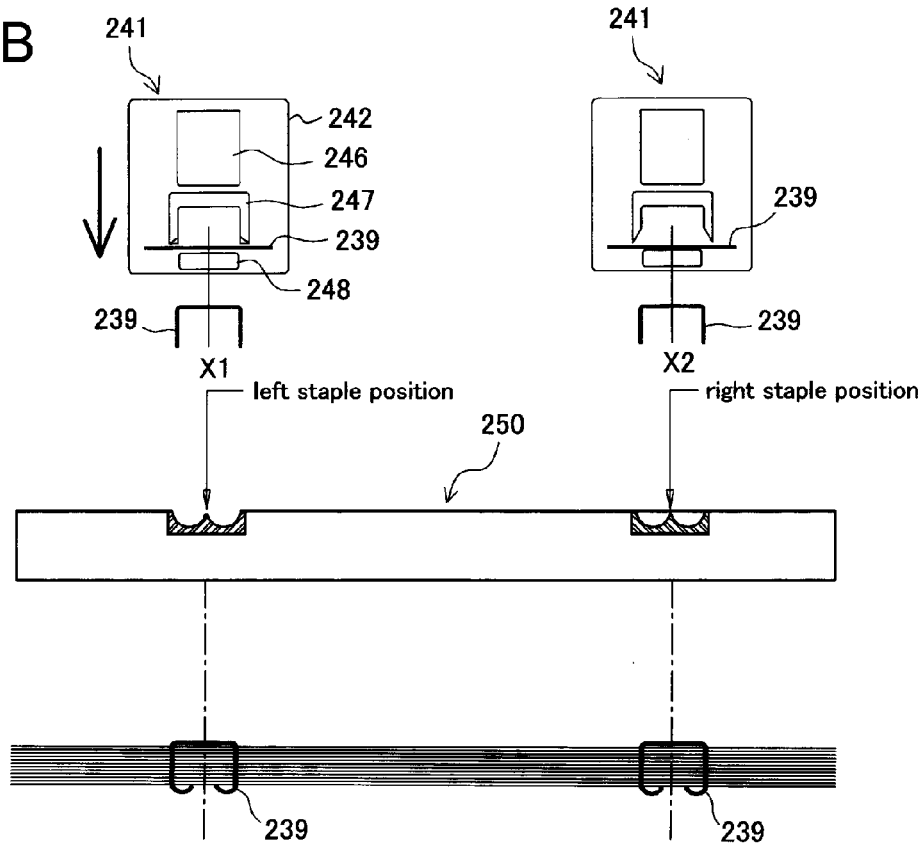

In other words, as shown in FIG. 9A, the driver unit 241 is fixed and supported on a bunch of sheets with staple support rods 251. By making such a configuration, it is possible to perform stale binding on the right and left of a bunch of sheets supported on the stacker section 40 in a fixed state without shifting the clincher unit 250.

Moreover, as the clincher unit 250, it is also possible to adopt a configuration in which a wing member (not shown) is provided to bend needle tips of the staple, and the driver unit 241 swings and rotates the wing member in conjunction (synchronization) with the needle tips to insert in a bunch of sheets. In this case, the frame of the clincher unit 250 axially supports a pair of bending wings swingably in positions opposed to needle opposite ends in the shape of a U. Then, in conjunction with operation for inserting the metal staple 239 into a bunch of sheets with the driver unit 241, a pair of bending wings are swung. By swings of the pair of wings, the needle front ends of the staple are bent in a flat state along the backside of a bunch of sheets. In other words, in bending with the bending groove as described previously, the staple front end is bent in the shape of a U (lens clinch), while being bent linearly (flat clinch) in bending with the wing member described later. The present invention is capable of adopting both of the configurations.

By such a configuration, in the driver unit 246 and former 247 incorporated into the head member 242, by rotation of the staple motor MD, the driver cam 244 presses a driver lever 245 down from the upper top dead center to the lower bottom dead center via an energy accumulation spring. By this descent operation of the driver lever 245, the driver unit 246 and former 247 coupled thereto shift from the top dead center to the bottom dead center. The driver member 246 is comprised of a plate-shaped member to press down the rear portion of the staple bent in the shape of a U, and as shown in FIG. 9B, the former 247 is comprised of a member in the shape of a U and bends the staple in the shape of a U between the former and the bending block 248. In other words, the cartridge 243 supplies the metal staple 239 to the bending block 248. The linear metal staple 239 is press-formed in the shape of a U between the former 247 and the bending block 248. Next, for the metal staple 239 bent in the shape of a U, the driver member 246 presses down toward a bunch of sheets vigorously and thereby inserts the staple into the bunch of sheets, and saddle stitching of the sheets is performed.

[Explanation of the Sheet Aligning Mechanism]

As described in FIG. 3 previously, on the downstream side of the adhesion unit 50, the aligning member 48 is disposed on opposite sides thereof to shift in the width direction of the sheet and press the sheet side edges inside the stacker section 40.

Although not shown particularly, an aligning motor M12 to drive the aligning member 48 is controlled to drive and rotate by a sheet binding • adhesion processing operation control section 201 described later. In this Embodiment, the application position of adhesion of the sheets with the adhesive applied and bonded retracts to the retract path 47. By this means, it is possible to align also sheets in a straddling state in which a new sheet to bond next is positioned in the carry-in path 41 and front ends of both sheets come into contact with the stopper section 90. Further, the aligning member 48 is disposed in this position, and aligns the sheet with the adhesive applied to the surface and the next sheet immediately before bonding, and therefore, alignment accuracy is enhanced in the bonded sheets.

[Explanation of Separation Mechanisms Such as the Transport Roller and the Like]

Next, it is necessary to release the nip and press-contact with the sheet in aligning operation of the aligning member 48. This mechanism is not shown in the figure particularly, and for example, for the transport roller 46 in FIG. 3, it may be configured that the pinch roller in press-contact with the roller is supported by an arm, and by shifting the arm, separates from and contacts the transport roller 46. Further, when the pressurizing roller positioned on the downstream side of the aligning member 48 is supported by the arm shown in the figure, and is configured to shift between the dashed-line position and the position as shown in FIG. 3, the roller presses a sheet to transport to the downstream side in the solid-line position, and separates from the sheet in the dashed-line position to allow the sheet to shift to the upstream side by the stopper section 90.

In addition, for up and down of the pressurizing roller 49, the roller 49 may be coupled directly to a solenoid or the like to move up and down.

[Explanation of Gripper Open/Close Mechanism of the Stopper Section]

Figure 10B:
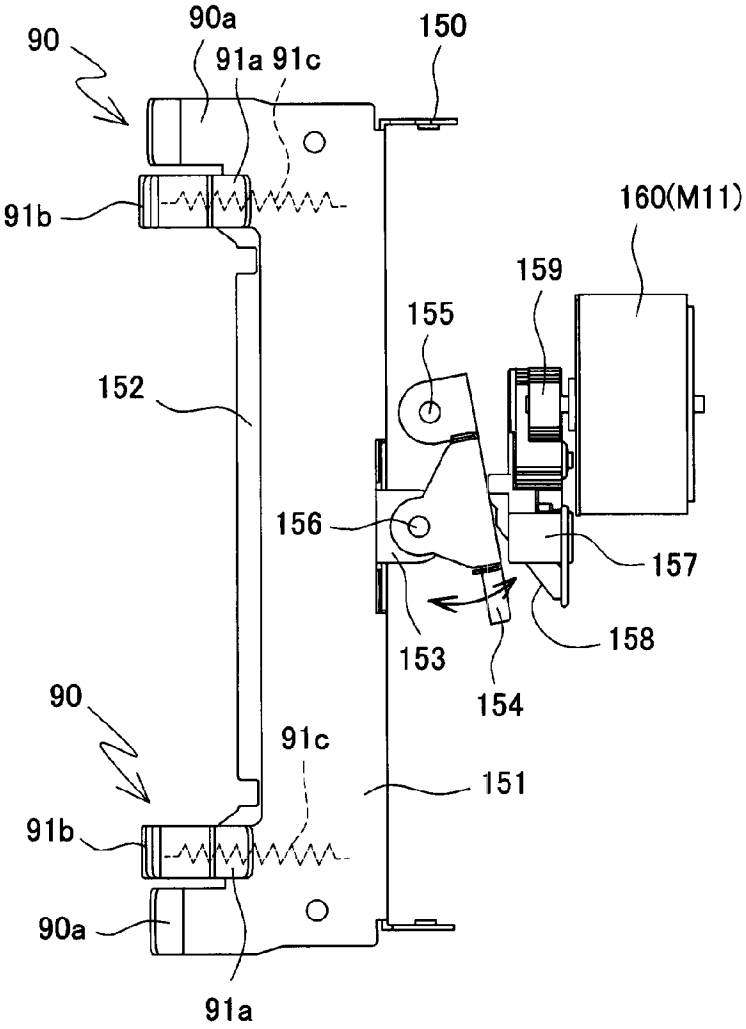
FIG. 10B is an explanatory view of planes of the stopper section and gripper.
Figure 10A:
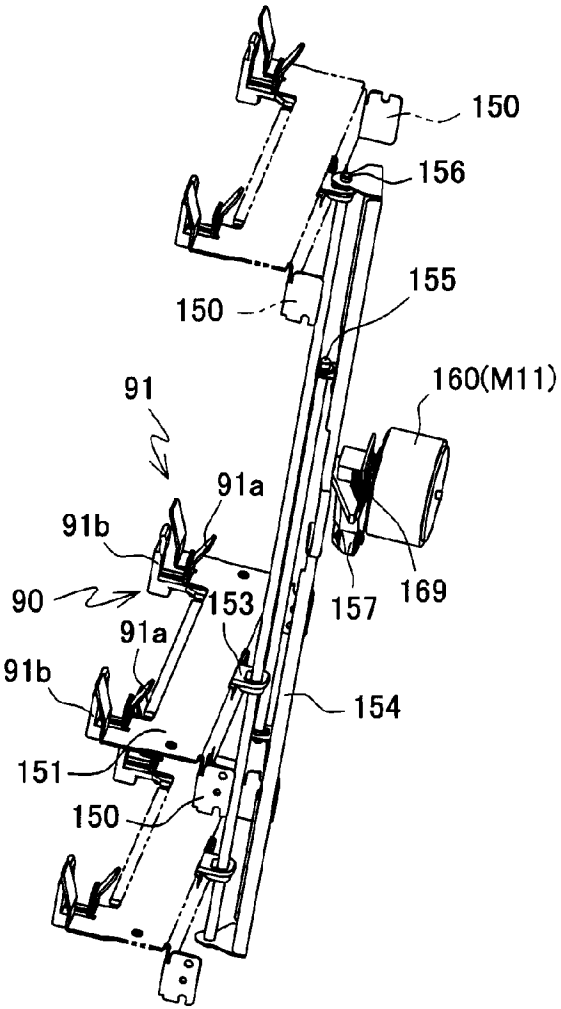
FIG. 10A is an explanatory view of a stopper section and gripper moving up and down inside the stacker section.

Referring to FIGS. 10A and 10B, described are a closed state for grasping the sheet of the gripper 91 positioned at the front end of the stopper section 90 and an open state for releasing the grasp. In addition, up and down of the stopper section 90 has already been described, and the description thereof is omitted herein.

FIG. 10A illustrates the entire shift range of the gripper 91, and shows the gripper in the upper and lower positions by virtual lines. FIG. 10B is a plan view in viewing the gripper 91 from above together with the stopper section 90. The gripper 91 is disposed at the front end of the stopper section 90, and is configured by shift pieces 91*b* separating from and contacting fixed pieces 91*a* of the stopper section 90. A gripper coupling section 152 of the shift pieces 91*b* is disposed to overlap and be able to move to and retract below the stopper section 90 and stopper coupling section 151. Further, below the shift piece 91*b* is provided a close spring 91*c* for always biasing the shift piece 91*b* to a close direction.

In addition, the gripper coupling section 152 has a coupling arm 153 with an opening hole protruding from the stopper section 90 backward. A rotating bracket 154 is provided to support a rotating bar 156 penetrating the opening hole of the coupling arm 153 in the upper and lower portions. In this rotating bracket 154, as shown in FIG. 10B, the side opposite to a rotating shaft 155 rotates in the direction shown by the arrow about the rotating shaft 155 as an axis. For rotation of the rotating bracket 154, a rotating cam 157 has a bracket pressing surface 158. The rotating cam 157 rotates by a gripper open/close motor 160 (M11). By this rotation, when the bracket pressing surface 158 presses the rotating bracket 154, the bracket swings about the rotating shaft 155. By this swing, the rotating bar 156 supported by the rotating bracket 154 in the upper and lower portions also shifts to move forward and backward. Since the rotating bar 156 penetrates the opening hole of the coupling arm 153, the shift piece 91*b* at the front end of the coupling arm 153 separates from and contacts the fixed piece 91*a* of the stopper section 90.

Further, as shown in FIG. 10A, in the above-mentioned coupling arm 153, even when the stopper section 90 moves up and down, the rotating bar 156 is positioned in this up-and-down range, and it is thereby possible to shift to move forward and backward the shift pieces 91*b* constituting the gripper 91 in any of up-and-down positions. Accordingly, a stacker section collection operation control section 200 controls the closed state in which the gripper 91 grasps the sheet and the open state in which the grasp is released, using rotation of the gripper open/close motor 160. As shown in FIG. 10A, since the stacker section 40 is disposed in an inclined state, the rotating bracket 154 is always in contact with the rotating cam 157. In addition, in contact with the rotating cam 157, the rotating bracket may be biased to the rotating cam 157 side using a spring or the like.

[Explanation of Mechanism and Operation of the Folding Processing section]

Figure 11A:
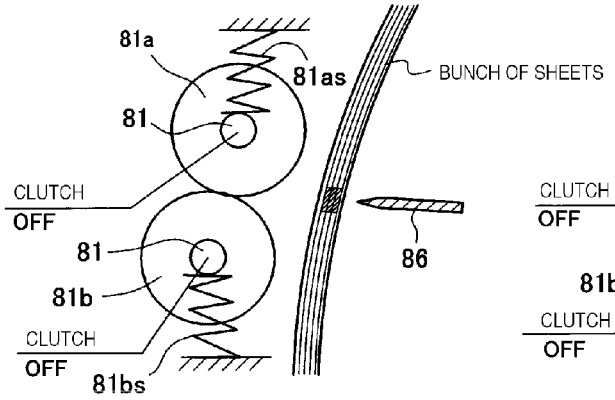
FIGS. 11A-11D contain explanatory views of a folding roller mechanism in the apparatus of FIG. 2, where

Described next is a configuration of the folding processing section 80 for performing folding processing in a bonded bunch folding position Sh2 when a bonded bunch shifts to this position. In a folding position Y disposed on the downstream side of the adhesion unit 50, as shown in FIG. 11A, in the position are provided the folding roller 81 for folding a bunch of bonded sheets, and the folding blade 86 for inserting the bunch of sheets into a nip position of the folding roller 81. The folding roller 81 is comprised of rollers 81*a*, 81*b* in press-contact with each other, and each roller is formed approximately in a width length of a maximum sheet. In the rollers 81*a*, 81*b* constituting the folding roller 81, rotating shafts 81*ax*, 81*bx* are fitted into long grooves of the apparatus frame, not shown, so as to come into press-contact with each other, and are biased in the press-contact direction by compression springs 81*a*S, 81*b*S. In addition, the rollers may be of structure where at least one is axially supported to be able to shift in the press-contact direction, and a biasing spring is applied to the one roller.

The pair of folding rollers 81*a*, 81*b* are formed of materials such as a rubber roller with a relatively high coefficient of friction. This is because of shifting the sheet in the rotation direction while folding with a soft material such as rubber, and the rollers may be formed by performing lining processing on rubber materials.

Figure 11B:
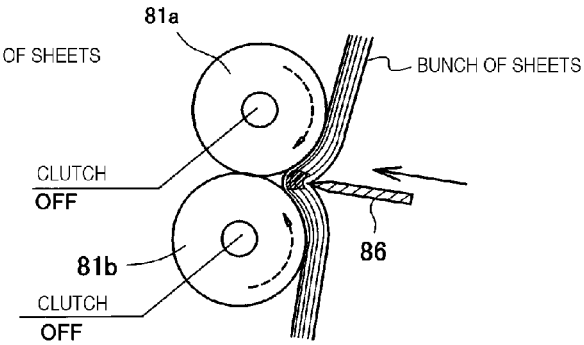
Figure 11C:
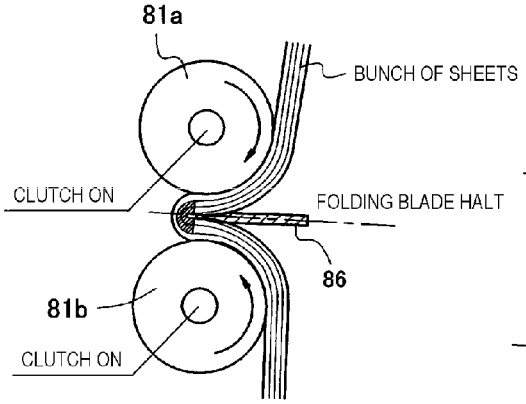

Described next is operation for folding sheets with the above-mentioned folding roller 81, according to FIGS. 11A and 11B. The pair of folding rollers 81*a*, 81*b* are positioned above the stacker section 40, while being positioned below the adhesion unit 50, and the folding blade 86 having a knife edge is provided in an opposite position with a bunch of bonded sheets supported on the stacker section 40 therebetween. The folding blade 86 is supported by the apparatus frame to be able to reciprocate between a waiting position in FIG. 11A and a nip position in FIG. 11C.

Then, the bunch of sheets supported in the shape of a bunch on the stacker section 40 is locked by the stopper section 90 at the front end in a state of FIG. 11A, and as a fold position thereof, the position to which the adhesive is applied with the adhesive tape stamper 51 is positioned as the folding position. Upon obtaining a set end signal of the bunch of sheets, a drive control section ("sheet folding processing control section 202" as described later; the same in the following description) switches a clutch section to OFF.

Figure 11D:
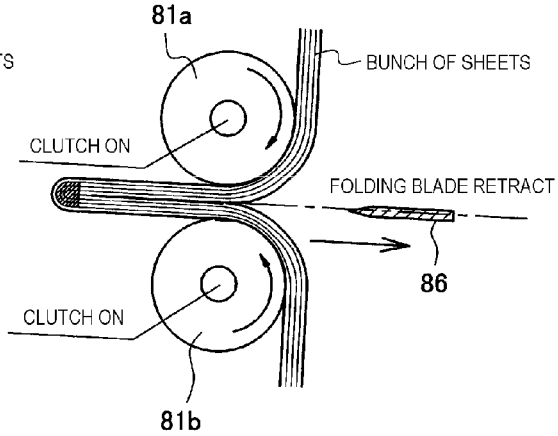

Then, the sheet folding processing control section 202 shifts the folding blade 86 from the waiting position to the nip position at a predetermined velocity. Therefore, in a state of FIG. 11B, the bunch of sheets is bent in the fold position by the folding blade 86 and is inserted in between the rollers. At this point, each of a pair of folding rollers 81 is driven to rotate while following the sheets shifting by the folding blade 86. Then, after a lapse of predicted time the bunch of sheets arrives at a predetermined nip position, the sheet folding processing control section 202 halts a blade drive motor (not shown), and rests the folding blade 86 in a position of FIG. 11C. In tandem therewith, the sheet folding processing control section 202 switches the clutch section, not shown, to the ON state to drive and rotate the folding rollers 81. Then, the bunch of sheets is fed out in a feed out direction (the left side in FIG. 11C). Subsequently, in a state of FIG. 11D, the sheet folding processing control section 202 shifts and returns the folding blade 86 positioned in the nip position toward the waiting position, in parallel with feeding out of the bunch of sheets by the folding rollers 81.

In thus folded bunch of sheets, first, when the bunch of sheets is inserted in between a pair of folding rollers 81, the sheet in contact with the roller surface is not drawn into between the rollers by the rotating rollers. In other words, since the folding rollers 81 rotate by following (being driven by) sheets to insert (push), it does not happen that only the sheet in contact with the rollers is first entangled. Further, since the rollers are driven and rotate by following the sheets to insert, the roller surface and the sheet in contact with the surface do not rub against each other, and the image is not rubbed.

Herein, returning to FIG. 2, on the downstream side of the folding rollers 81 is provided a sheet shift path (hereinafter, referred to as "shift path") for guiding the folded sheets to the second sheet discharge tray 22 for storing booklets that are folded bunches of sheets, and by the bunch sheet discharge roller 95 having the kicking piece provided at the exist thereof, the bunch of sheets folded in two in the shape of a booklet by the folding rollers 81 is carried out to the second sheet discharge tray 22. The bunch of sheets to carry out is collected while being aligned by the bunch pressing guide 96 and the bunch press 97 for preventing the bunch of sheets folded in two from opening.

[Explanation of Operation of Bonding and Binding]

Next, referring to FIGS. 12A to 14C, described sequentially is operation for applying the adhesive to three sheets transported from the image formation apparatus A with the adhesion unit 50 inside the stacker section 40, and preparing a bunch of mutually bonded sheets. Further, referring to FIGS. 15A-15C and 16A-16C, described is operation for performing staple binding on three sheets with the staple binding unit 240 for performing saddle stitching.

[Explanation of Sheet Bunch Preparation Operation by Adhesion]

Described first is a state for bonding sheets to one another with the adhesive to prepare a bunch of sheets. The image formation apparatus indicates the "adhesion sheet bunch folding mode" for bonding sheets from the main-body discharge outlet 3 on a sheet-by-sheet basis in the shape of a bunch, then folding in the shape of a booklet, and storing in the second sheet discharge tray 22.

Figure 12A:
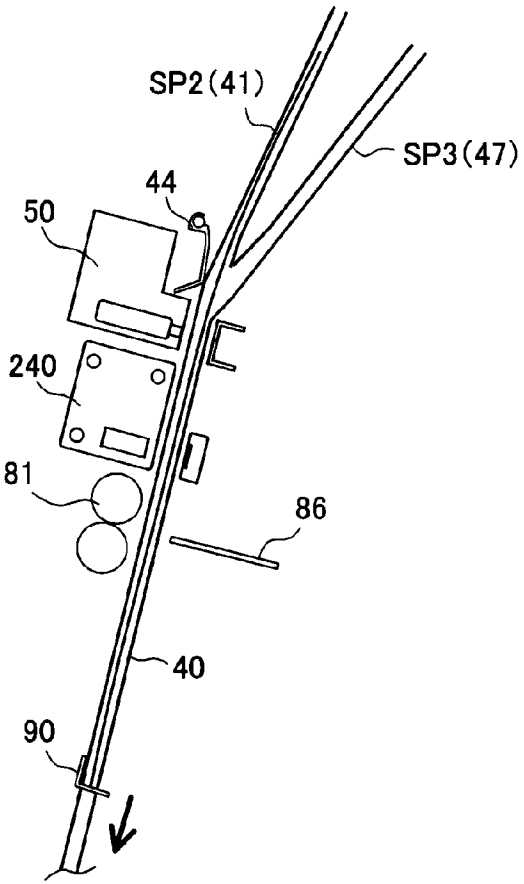
FIGS. 12A-12C contain sheet flow views for using the adhesion unit between the adhesion unit and the staple binding unit of the sheet processing apparatus and bonding sheets to be a bunch, where

FIG. 12A is a view where a first preceding sheet from the image formation apparatus A is carried in the stacker section 40 along the carry-in path 41 from the sheet carry-in path P1 via the second switchback path SP2. The stopper section 90 may be in Sh1 in FIG. 2 or as shown in FIG. 12A, may be down to attract the sheet toward Sh1.

Figure 12B:
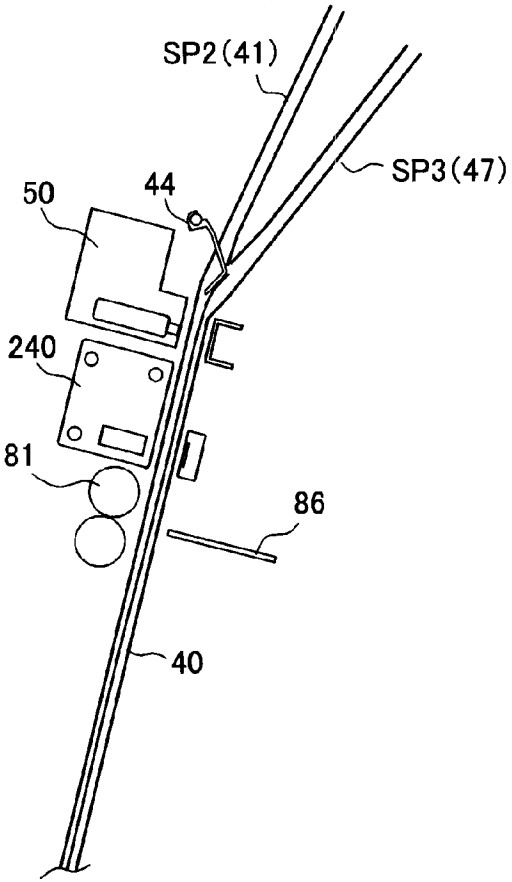

As shown in FIG. 12B, the sheet is once halted at the time the sheet rear end arrives at the branch position of the carry-in path 41 and the retract path 47 constituting the third switchback path SP3. The sheet rear end is biased to the retract path 47 side by the deflecting guide 44 existing in the branch position.

Figure 12C:
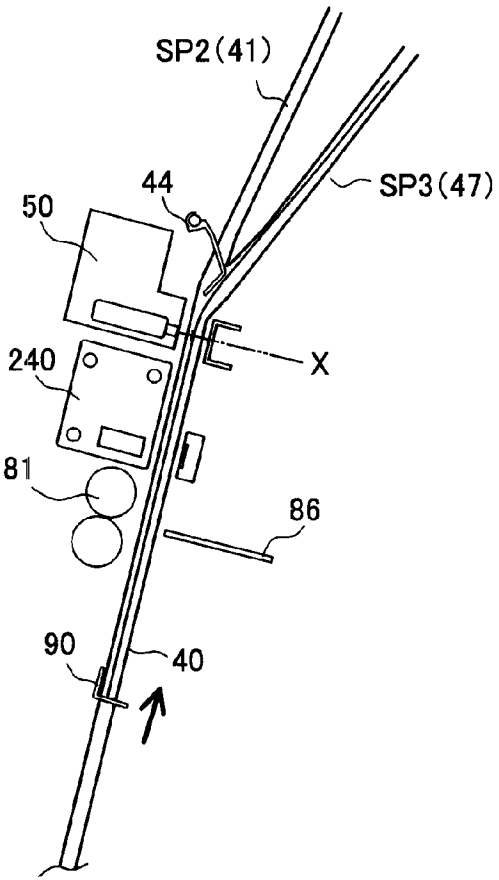

Next, as shown in FIG. 12C, when the stopper section 90 is moved up, the sheet rear end side shifts along the retract path 47. By this shift, when a position of ½ the length of the sheet in the transport direction is positioned under the adhesion unit 50, the sheet is once halted, and the adhesive tape stamper 51 is pressed to the sheet to apply the adhesive. The reason why the adhesive is applied in this sheet upward process is to prevent the sheet from being transported with the adhesive applied, which occurs when the adhesive is applied earlier on the downward side. When the adhesive is applied in the sheet upward process, it is possible to shift to the application retract position of the retract path 47 immediately, and it is possible to prevent the adhesive from adhering to an unnecessary portion.

Figure 13A:
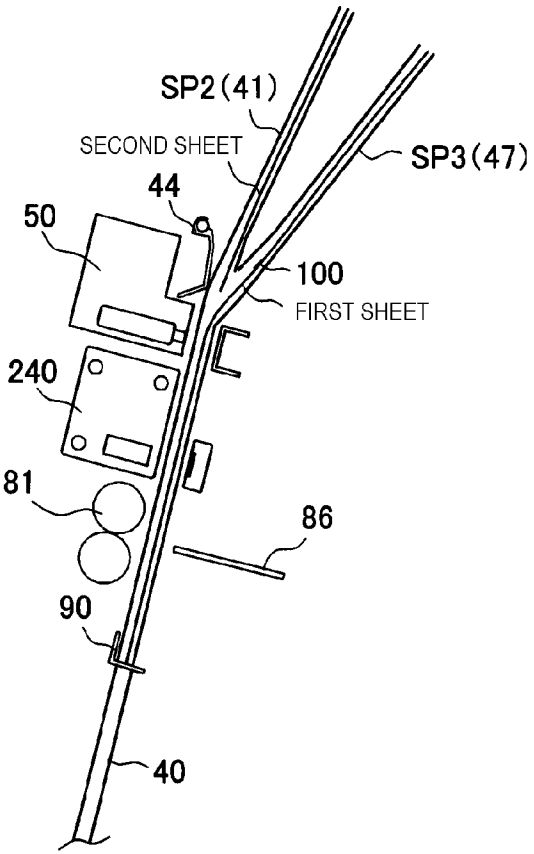
FIGS. 13A-13C contain sheet flow views subsequent to FIGS. 12A-12C, where

In FIG. 13A, in carrying a second next sheet in the carry-in path 41, the application position of the first sheet is retracted into the retract path 47. By this means, it is possible to carry in the stacker section 40 without the front end of the second sheet to carry in contacting the application position of the adhesive of the first sheet. In this sheet overlapping state, the aligning member 48 aligns the sheets before adhesion.

Figure 13B:
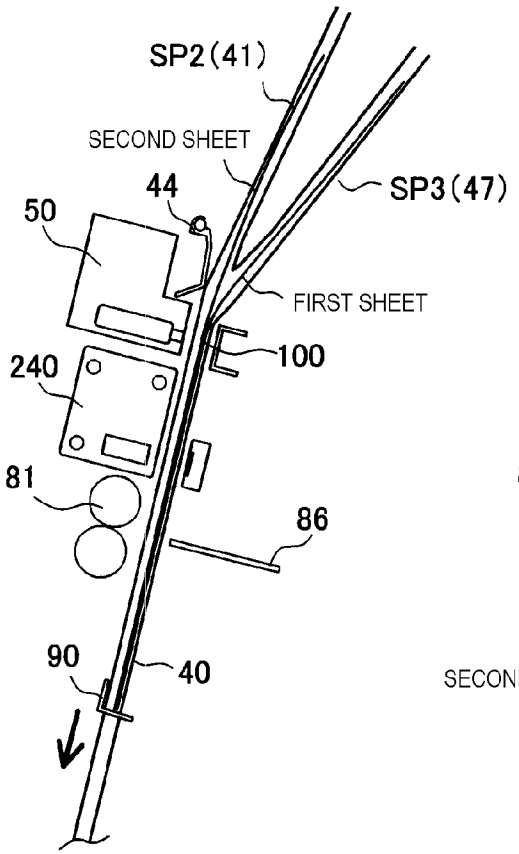

In FIG. 13B, in a position in which the application position of the first sheet coincides with the ½ position of the second sheet, the stopper section 90 and pressurizing roller 49 press the sheets to shift to the downstream side to carry in the stacker section 40.

Figure 13C:
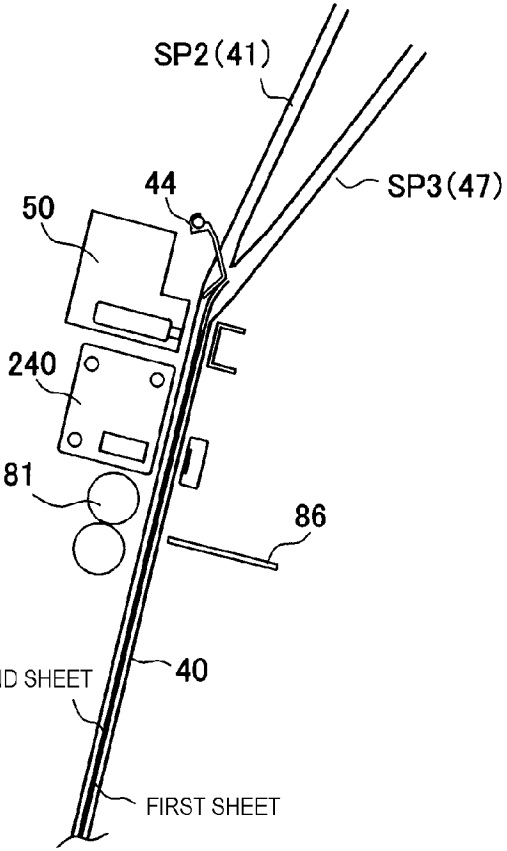

FIG. 13C illustrates a state in which the rear end of two overlapping sheets is once halted at a point passing the branch position. This time, since the rear end is biased to the deflecting guide 44 by moving up the stopper section 90, the overlapping sheets are switched back inside the retract path 47 of the third switchback path SP3. This operation is the same as in FIG. 12B described already, and the adhesive tape stamper 51 is pressed to the sheet in the ½ position of the subsequent sheet to apply the adhesive.

In addition, in switching back the sheet, the pressurizing roller 49 is separated from the sheet.

Figure 14A:
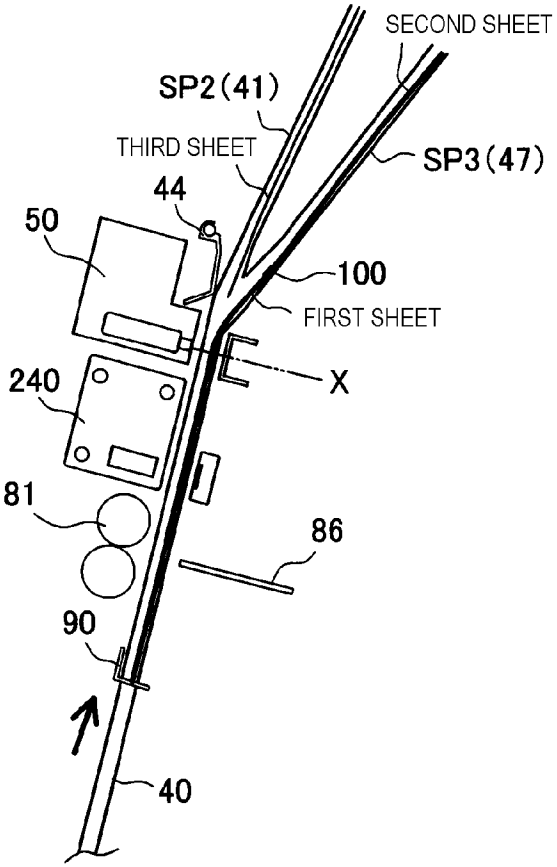
FIGS. 14A-14C contain sheet flow views subsequent to FIGS. 13A-13C, where
Figure 14B:
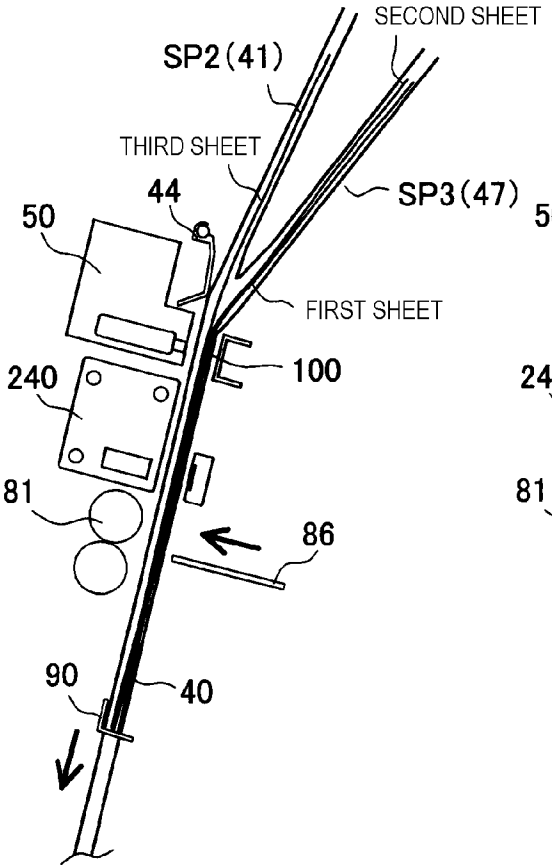
Figure 14C:
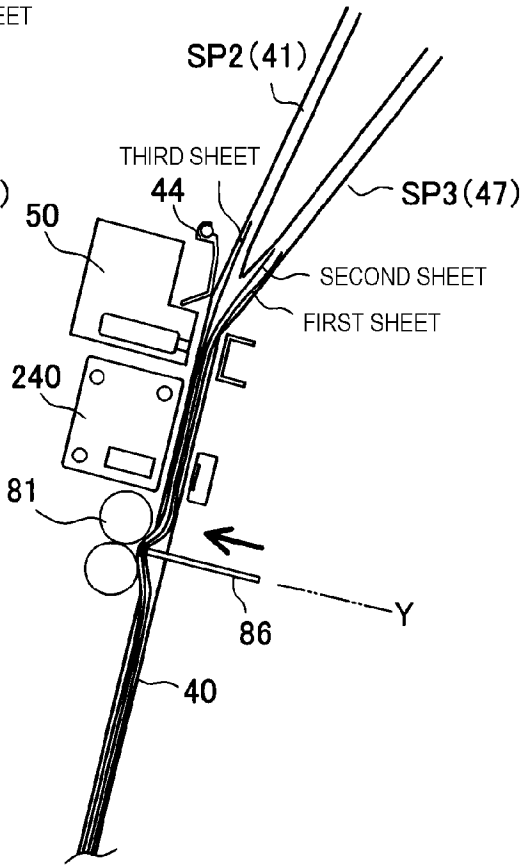

FIG. 14A illustrates a state in which the adhesive application position of the second sheet is retracted into the retract path 47, in carrying a third sheet in the carry-in path. This state is the same as in FIG. 13A. Accordingly, in carrying the third sheet in the stacker section 40, there is no risk that the front end is caught in the adhesion portion of the second sheet. In FIG. 14B, the sheets are aligned in a position in which the ½ position of the third sheet is the adhesion positions of two sheets, and are shifted further to the downstream side by the stopper section 90. In FIG. 14C, since the third sheet is the last sheet, application of the adhesive with the adhesion unit 50 is not performed on the sheet, the sheet press 65 presses the third sheet, and the pressurizing roller 49 is also moved down to press the sheet. By this pressing, the sheets are bonded to one another, and are shifted to the position of the folding rollers 81 and folding blade 86. The position of the folding processing section 80 is the ½ position of the bonded sheets, the sheets are bonded in this position, and the bonded folded booklet is stored in the second sheet discharge tray.

As described above, in the apparatus of this Embodiment for bonding sheets in the adhesion unit, a preceding sheet with the adhesive applied is once shifted into the retract path 47 to isolate the application position from the sheet front end whenever the sheet is bonded, it is thereby possible to prevent the adhesive from adhering to a position such as the next sheet front end except bonding, and it is possible to prepare a bonded booklet excellent in finish state.

[Explanation of Binding Processing with the Staple]

Herein, described is a state for binding three sheets at the midpoint in the transport direction of the sheet with the staple binding unit using binding needles such as metal staples to prepare a bunch. In this case, the image formation apparatus indicates the "staple binding sheet bunch folding mode" for collating sheets from the main-body discharge outlet 3 in the shape of a bunch, then performing saddle stitching with staples, and folding in the shape of a booklet to store in the second sheet discharge tray 22.

Figure 15A:
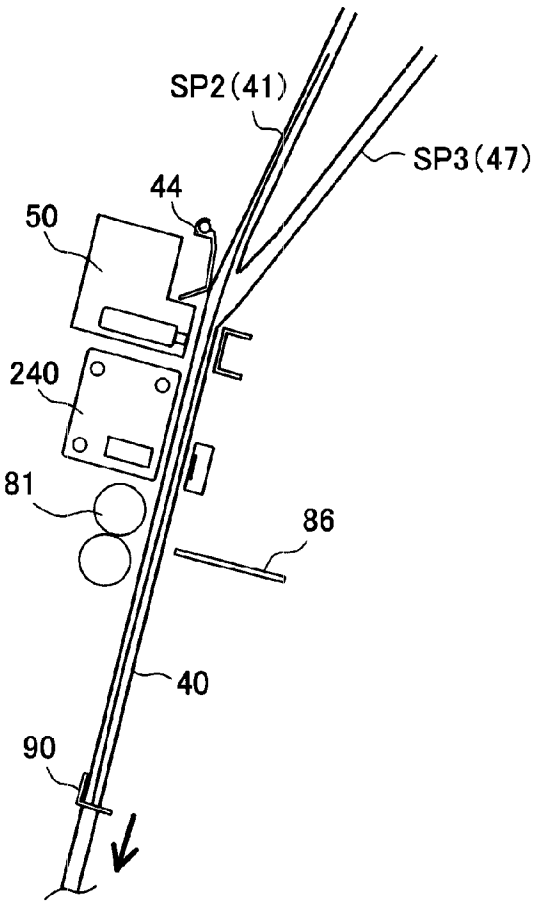
FIGS. 15A-15C contain sheet flow views for performing binding processing on sheets with the staple binding unit as a staple saddle stitching stapler, where

FIG. 15A is a view where a first sheet from the image formation apparatus A is carried in the stacker section 40 along the carry-in path 41 from the sheet carry-in path P1 via the second switchback path SP2. The stopper section 90 may be in Sh1 in FIG. 2 or as shown in FIG. 15A, may be down to attract the sheet toward Sh1.

Figure 15B:
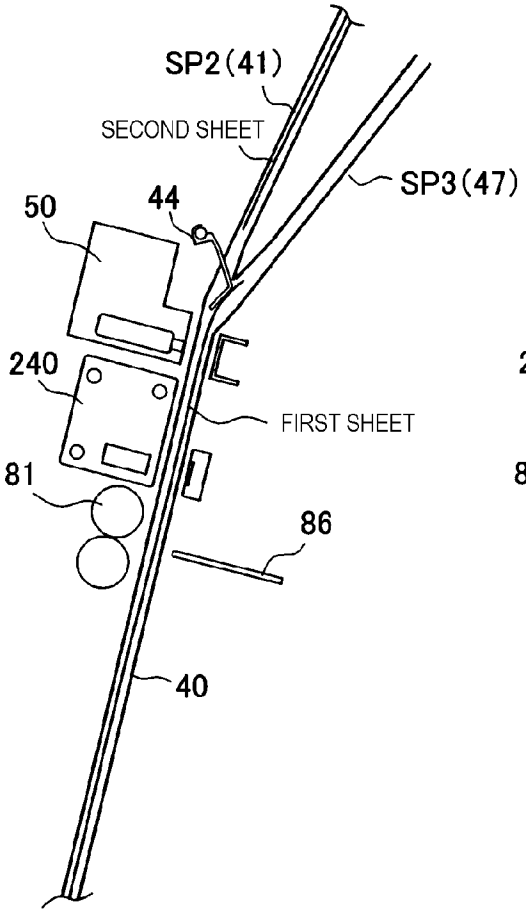

As shown in FIG. 15B, the sheet is once halted at the time the sheet rear end arrives at the branch position of the carry-in path 41 and the retract path 47 constituting the third switchback path SP3. The sheet rear end is biased to the retract path 47 side by the deflecting guide 44 existing in the branch position. At the time the carry-in is completed, the aligning member 48 aligns the sheet.

Figure 15C:
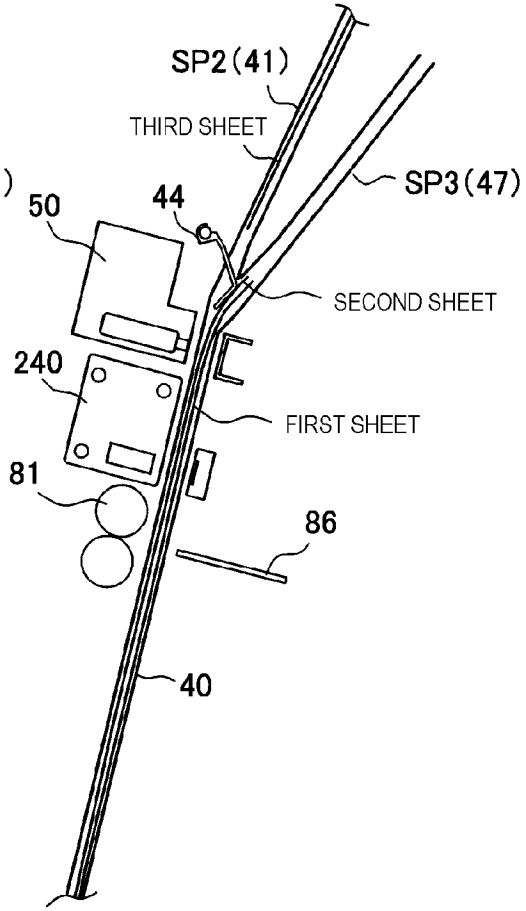

FIG. 15C illustrates a state in which while the first sheet is biased to the retract path 47 side, a second sheet is carried in, and the rear end of the second sheet is also biased to the retract path 47 side by the deflecting guide 44. Also in this case, at the time the carry-in is completed, the aligning member 48 aligns the sheets.

Figure 16A:
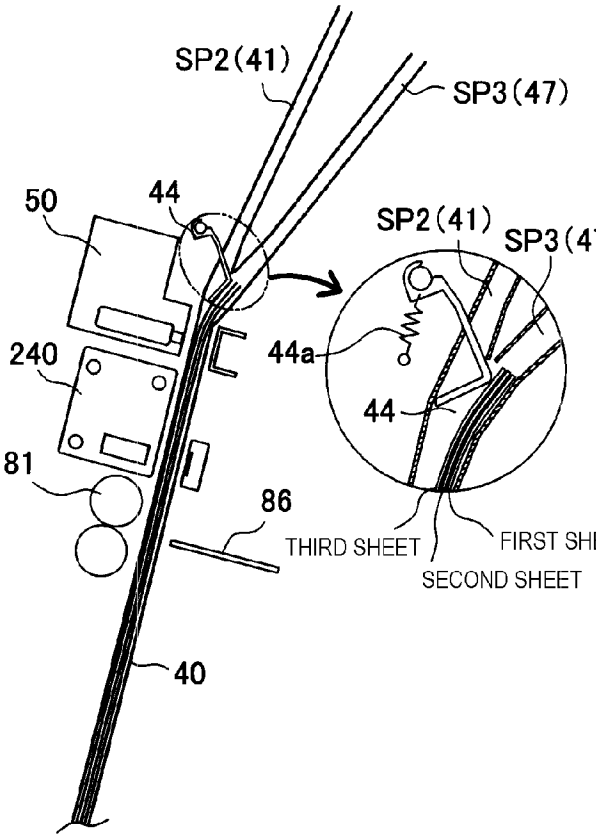
FIGS. 16A-16C contain flow views in binding with the staple binding unit subsequent to FIGS. 15A-15C, where

In FIG. 16A, carry-in of the third sheet in the stacker section 40 is completed, and the deflecting guide 44 biases the rear end to the retract path 47 side constituting the third switchback path SP3. As shown in the enlarged view in FIG. 16A, for this bias, a bent portion of the deflecting guide 44 biases the sheet rear end to the retract path side. By this bias, it is possible to prevent the sheet rear end from blocking the exit of the carry-in path 41. Accordingly, it is possible to carry the next sheet in the stacker section 40 without being caught in the rear end of the preceding sheet.

In addition, in this Embodiment, the deflecting guide 44 biases to the retract path 47 side with a guide pulling spring 44*a*, and biasing of the deflecting guide 44 to the sheet may be configured to work under its own weight without using a spring. Further, the deflecting guide 44 may be coupled to a solenoid so as to move up and down whenever a next sheet is carried in the stacker section 44. Furthermore, in order to carry a next sheet in the stacker section 40 more smoothly, it may be configured that the rear end of the preceding sheet existing on the retract path 47 side is shifted to the back side of the retract path 47 and that the surface of the preceding sheet is outside the next sheet.

Figure 16B:
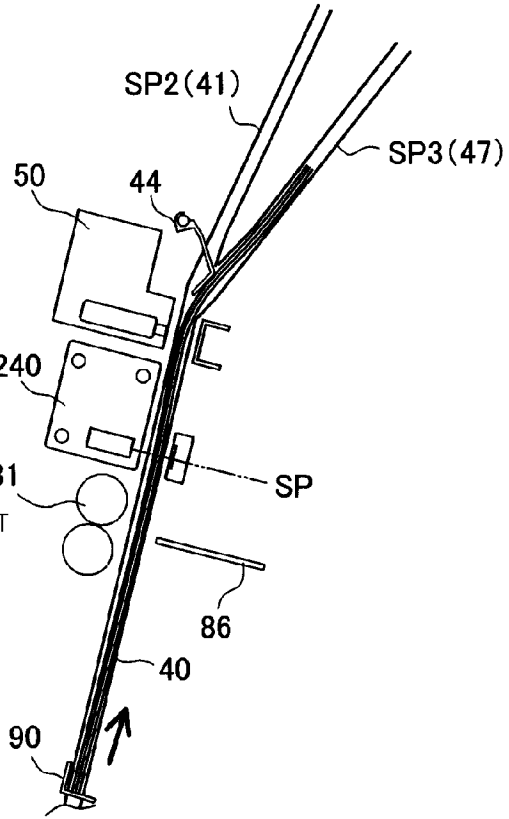

In FIG. 16B, after completing carry-in of three sheets in the stacker section 40, the aligning member 48 aligns the sheets. Subsequently, the stopper section 90 having the gripper 91 is moved up, and a position ½ the sheet length is shifted to a binding position of the staple binding unit 240 and is halted. In this case, in the sheets with a long sheet length, the rear end is shifted in the retract path 47. In addition, a sheet shift amount to the retract path 47 in binding sheets with the adhesion unit 50 is larger than a sheet shift amount to the retract path 47 in binding sheets with the staple binding unit 240. In other words, since the adhesion unit 50 is closer to the retract path 47 than the binding unit 240, the length of the retract path 47 is sufficient also in using the binding unit 240. Thereafter, the staple binding unit 240 performs binding with the metal staple 239.

Figure 16C:
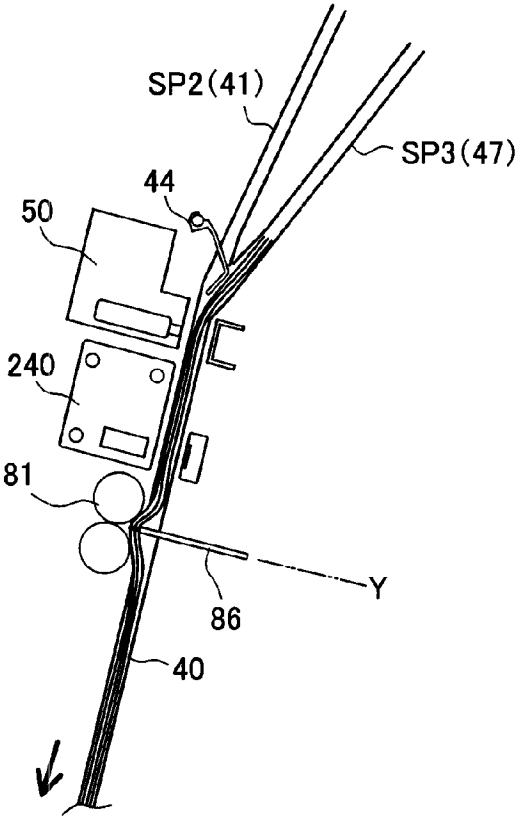

In FIG. 16C, the binding position is shifted to the folding processing section 80 comprised of the folding rollers 81 and folding blade 86 existing on the downstream side of the staple binding unit 240 to perform folding processing. After the folding processing, the staple-bound booklet is stored in the second sheet discharge tray.

As described above, the apparatus of this Embodiment biases the sheet rear end to the retract path 47 side used for the adhesion unit 50 using the same deflecting guide 44, also in binding sheets with the staple binding unit 240. Further, when necessary, the apparatus uses the retract path 47 to which the sheet is switched back in binding with the adhesion unit 50.

Accordingly, the stacker section 40, stopper section, deflecting guide 44 and retract path 47 are shared in binding or bonding sheets with the staple binding unit 240 or the adhesion unit 50, and it is intended to make the apparatus simplified and low cost.

[Explanation of Control Configuration]

Figure 17:
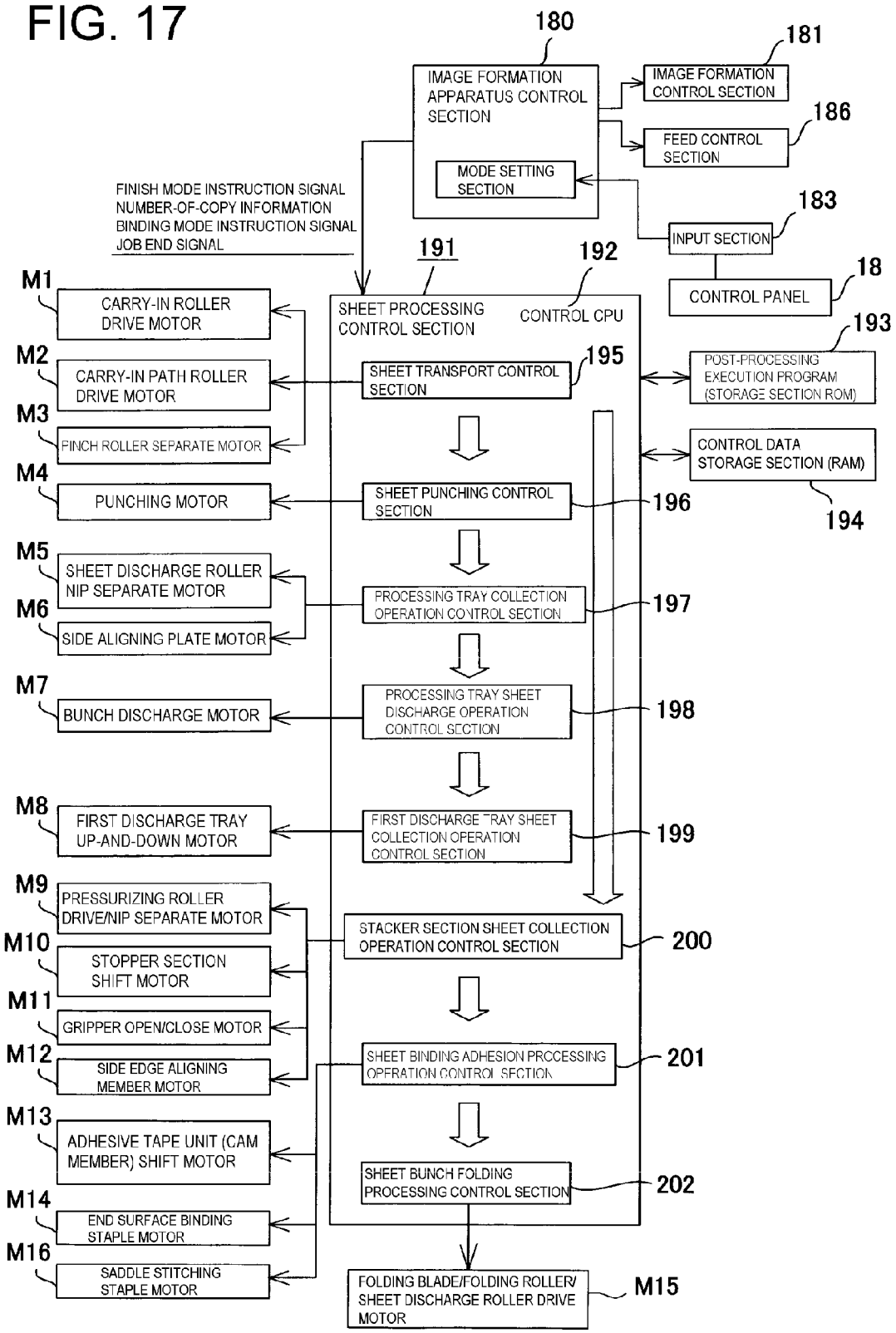
FIG. 17 is an explanatory diagram of a control configuration in the entire configuration of FIG. 1.

A system control configuration of the above-mentioned image formation apparatus will be described according to a block diagram of FIG. 17. The system of the image formation apparatus as shown in FIG. 1 is provided with an image formation apparatus control section 180 of the image formation apparatus A, and a sheet processing control section 191 of the sheet processing apparatus B. The image formation apparatus control section 180 is provided with an image formation control section 181, paper feed control section 186, and input section 183. Then, from the control panel 18 provided in the input section 183 are set the "image formation mode" and "sheet processing mode". As described previously, in the image formation mode are set the number of printout copies, sheet size, color/monochrome printing, scaling printing, one-sided/two-sided printing and other image formation conditions. Then, the image formation apparatus control section 180 controls the image formation control section and paper feed control section corresponding to the set image formation conditions, forms images on predetermined sheets, and carries out the sheets sequentially from the main-body discharge outlet 3.

Concurrently therewith, the sheet processing mode is set by input from the control panel 18. As the processing mode is set the "printout mode", "staple binding mode", "adhesion sheet bunch folding mode", "staple saddle stitching sheet bunch folding mode" or the like described already. Then, the image formation apparatus control section 180 transfers the processing finish mode of sheets, the number of sheets, number-of-copy information, and information of binding, adhesion mode or staple binding mode (one-portion binding, multi (two or more)-binding or saddle stitching) to the sheet processing control section 191.

The sheet processing control section 191 is provided with a control CPU 192 for operating the sheet processing apparatus B corresponding to the designated finish mode, ROM 193 for storing operation programs, and RAM 194 for storing control data. Then, the control CPU 192 is provided with a sheet transport control section 195 for executing transport of sheets fed to the carry-in entrance 23, a sheet punching control section 196 for performing punching processing on a sheet with a punch unit 28, a processing tray collection operation control section 197 for performing correction operation of sheets on the processing tray 29, a processing tray discharge operation control section 198 for discharging bunch-made sheets from the processing tray 29, and a first sheet discharge tray collection operation control section 199 for moving the first discharge tray up and down corresponding to a collection amount of sheets and bunches of sheets discharged from the processing tray 29.

Further, the CPU 192 is provided with the stacker section collection operation control section 200 to control in collecting sheets on the stacker section 40, bonding and folding a bunch of sheets, the sheet binding • adhesion processing operation control section 201 for designating operation to bond sheets, and the sheet folding processing control section 202 for folding a bunch of adhesive-bonded sheets in two. In addition, the sheet binding • adhesion processing operation control section 201 controls also the end surface binding stapler 35 for performing binding processing on sheets collected on the processing tray 29 with a staple, the adhesion unit 50 for bonding sheets carried in the stacker section 40 on a sheet-by-sheet basis, and the staple binding unit 240 for performing saddle stitching on sheets collected on the stacker section 40. In addition, not particular shown in the figure, to each control section are input position signals from sensors for detecting positions of the sheet transport path and each member.

Further, linkage between each control section and each motor portion will be described with reference to FIG. 17. First, the sheet transport control section 195 is coupled to a control circuit of the drive motor M1 to control driving of the carry-in roller 24 and the like for receiving and transporting sheets from the image formation apparatus A. Further, the sheet transport control section 195 once switches back a sheet to the second switchback transport path SP2 to wait in carrying the sheet in the processing tray 29, and discharges the sheet to the processing tray 29 together with a next sheet. This is because it is made possible to perform processing without halting operation of the image formation apparatus A side, and in order to enable the switchback transport to be performed, the section 195 controls the drive motor M2 for enabling the path carry-in roller 45 in the carry-in path 41 to transport forward and backward. Further, the section 195 controls also a separate motor 131 (M3) for separating a pinch roller 125 from a drive roller 120 in aligning sheets by positioning the front end side thereof in the stacker section 40, and positioning the rear end side in the carry-in path 41.

Next, the sheet punching control section 196 is connected to a control circuit of a punching motor M4 to punch a punch hole in the sheet.

The processing tray collection operation control section 197 is connected to a control circuit of a nip separate motor M5 for nipping or separating the sheet discharge roller 25 to carry in the processing tray 29 and the first sheet discharge tray 21 and carry out a bunch of sheets from the processing tray 29. Further, the section 197 is connected to a control circuit of the side aligning plate motor M6 for causing the side aligning plates 36 to reciprocate in the sheet width direction to align the sheet on the processing tray 29.

The processing tray discharge operation control section 198 is connected to a control circuit of the bunch sheet discharge motor M7 for shifting the rear end regulation member 33 toward the sheet discharge outlet 25*a*, in order to discharge a bunch of sheets with the end portion bound with the end surface binding stapler 35 on the processing tray 29 to the first sheet discharge tray. Further, a control circuit of a first tray up-and-down motor M8 for moving the first sheet discharge tray 21 up and down corresponding to an amount of sheets to store is connected to the first sheet discharge tray collection operation control section 199 to control.

Next, according to the figures, described briefly is the control section which applies an adhesive to the ½ position in the sheet transport direction to bond sheets or performs staple binding on collected sheets, and folds in the application position of the adhesive or the staple binding position.

First, the stacker section collection operation control section 200 is connected, to control, to a control circuit of a pressurizing roller nip separate motor 141 (M9) which is positioned at the midpoint of the stacker section 40 to perform shifting to a pressing position of the pressurizing roller 49 for pressing the sheet carried in the stacker section 40 to transport to the downstream side, and separating from the sheet by rotation-driving and rotating backward.

Further, the section 200 is connected to a control circuit of the shift motor M10 of the stopper section 90 for controlling a position of a sheet moving to the stacker section 40 to shift and position in an initial home position Sh0, sheet (bunch) rear end branch passing position Sh1 in which the rear and of the sheet is in the branch position of the carry-in path 41 and the retract path 47 path, adhesion bunch folding position Sh2 for folding a bunch of adhesion-applied sheets in two, staple binding position Sh31 for performing saddle stitching on sheets at the midpoint with metal staples, adhesive tape transfer position Sh32 for applying the adhesive tape AT to the center of the sheet, and adhesive tape hiding position Sh4 in which the sheet is switched back to the retract path 47 to wait so as to prevent the adhesive application position of the preceding sheet from adhering in carrying the next sheet in the stacker section 40 from the carry-in path 41. The relationship of sheet flows among the positions and the like are as described specifically in FIGS. 12A to 16C.

Further, the stacker section collection operation control section 200 is also connected, to control, to a control circuit of the gripper open/close motor 160 (M11) for performing open/close operation to grasp the front end of the sheet with the front end of the stopper section 90 and open this grasp. The timing of grasp of the gripper and the like has been already described, and therefore, the description thereof is omitted. Further, the stacker section collection operation control section 200 is also connected, to control, to a control circuit of an aligning motor 117 (M3) for causing the aligning member 48, which is capable of aligning also sheets such that the sheet front ends are positioned in the stacker section 40 and that the rear ends are respectively positioned over the carry-in path 41 and retract path 47, to reciprocate in the sheet width direction.

The sheet binding • adhesion processing operation control section 201 is connected to a control circuit of a cam shift motor 60 (M13) for causing the cam member 57 to reciprocate and shift between the position for pressing the adhesive tape stamper 51 of the adhesion unit 50 to the sheet to apply the adhesive, and a position separated from the sheet. Further, the section 201 is also connected to a control circuit of the saddle stitching stapler motor M16 to perform saddle stitching on a bunch of sheets at the midpoint with the metal staple 239 after completion of collection on the stacker section 40. Furthermore, the sheet binding • adhesion processing operation control section 201 is connected to an end surface binding stapler motor M14 of the processing tray 29.

Finally, as described already, the sheet folding processing control section 202 is configured to drive to rotate or shift the folding blades 86, folding rollers 81*a*, 81*b*, and bunch sheet discharge roller 95 to reciprocate with a common motor, and is connected to a drive circuit to control also the drive motor M15.

The control sections configured as described above cause the sheet processing apparatus to execute the following processing operation. The operation of the "printout mode", "staple binding mode", "adhesion sheet bunch folding mode", and "staple saddle stitching sheet bunch folding mode" has been described already, the description thereof is thereby omitted herein, and particularly, the "adhesion sheet bunch folding mode" and "staple saddle stitching sheet bunch folding mode" have specifically been described respectively in FIGS. 12A to 14C and FIGS. 15A-15C and 16A-16C.

Each of the following effects is exhibited corresponding to each Embodiment of the present invention.

1. A sheet processing apparatus B for folding sheets after binding is provided with the stacker section 40 that collects sheets transported along a transport path (hereinafter, referred to as carry-in path 41), the sheet regulation member (stopper section 90) that regulates a sheet transported to the stacker section 40, the retract path 47 that is positioned on the upstream side of the stacker section 40 and that branches off from the carry-in path 41 to enable a sheet carried in the stacker section 40 to be transported in a direction opposite to a carry-in direction, the adhesion unit 50 that is positioned in a junction position of the carry-in path 41 and the retract path 47 to bond sheets by applying an adhesive, the staple binding unit 240 that binds the sheets collected in the stacker section 40 with staples, and the folding processing section 80 that folds the sheets which are bonded in the adhesion unit 50 or bound in the staple binding unit 240 and collected in the stacker section 40, where the retract path 47 is a path (including the application retract position 100) for retracting an application position of the preceding sheet with the adhesive applied, in carrying a next sheet in the stacker section 40, and the staple binding unit 240 is disposed in the stacker section 40 between the adhesion unit 50 and the folding processing section 80.

According to the apparatus, since the retract path 47 is provided on the upstream side of the stacker section 40 so as to shift the application position of the preceding sheet with the adhesive applied to a retract position (application retract position 100) and then enable carry-in of the next sheet to be performed, the application position of the adhesive of the preceding sheet is unnecessarily not brought into contact with the next sheet to carry in, and it is possible to bond in a designation position. Further, since the staple binding unit 240 capable of staple binding when necessary is provided between the adhesion unit 50 and the folding processing section 80, it is possible to provide a compact sheet processing apparatus which enables two types of binding of bonding of sheets and staple binding to be performed.

2. The sheet processing apparatus as described in above-mentioned 1 is further provided with the deflecting guide 44 for positioning the rear end in the transport direction of a sheet in the retract path 47 whenever the sheet is carried in the stacker section 40, in binding sheets with the staple binding unit 240, where the deflecting guide 44 guides the sheet to the retract path 47 side in binding sheets with the adhesion unit 50.

According to this configuration, the deflecting guide 44 is provided to position the sheet on the retract path 47 side in both of the cases of binding of sheets in the staple binding unit 240 and bonding binding of sheets in the adhesion unit 50, and it is thereby possible to provide the apparatus capable of avoiding a collision in sheet carry-in in staple binding, and of guiding the adhesion-applied sheet to the retract path 47.

3. The sheet processing apparatus as described in above-mentioned 2, where the adhesion unit 50 is comprised of a transfer tape (hereinafter, adhesive tape AT) including the adhesive on a tape substrate, application of the adhesive to the sheet is performed by pressing the adhesive tape AT to the sheet so that the adhesive is transferred from the adhesive tape AT to the sheet, and bonding of sheets is also performed by the pressing.

According to this configuration, it is possible to provide the apparatus which readily performs application to the sheet with ease in handling of the adhesive, and by pressing the adhesive tape AT, concurrently performs transfer bonding of the adhesive of the adhesive tape AT to the sheet and press-bonding of sheets.

4. A sheet processing apparatus for folding sheets after binding is provided with a transport path (hereinafter, referred to as carry-in path 41) for transporting a sheet, the stacker section 40 that collects sheets transported from the carry-in path 41, the sheet regulation member (hereinafter, stopper section 90) that regulates a sheet transported to the stacker section 40, the retract path 47 that is positioned on the upstream side of the stacker section 40 and that branches off from the carry-in path 41 to enable a sheet carried in the stacker section 40 to be transported in a direction opposite to a carry-in direction, the adhesion unit 50 that is provided in a junction point of the carry-in path 41 and the retract path 47 to bond sheets by applying an adhesive to a midpoint in the transport direction of the sheet, the staple binding unit 240 that binds the sheets collected in the stacker section 40 at the midpoint in the transport direction of the sheets with staples, the folding processing section that folds the sheets which are bonded in the adhesion unit 50 or bound in the staple binding unit and collected in the stacker section 40, and a control section (sheet processing control section 191) that controls the stopper section 90, the adhesion unit 50 and the staple binding unit 240, where the control section controls to apply the adhesive to an application position of a preceding sheet transported from the carry-in path 41 to the stacker section 40 in binding sheets with the adhesion unit 50, carry in a next sheet after retracting the application position to the retract path, overlap the preceding sheet and next sheet to shift, and then, apply the adhesive to the next sheet to form a bunch of sheets, and controls to bind sheets to prepare a bunch of sheets after all of the sheets to perform binding processing being carried in the staple binding unit 240, in binding the sheets with the staple binding unit 240.

According to the apparatus, it is possible to provide a compact apparatus for reducing contact with the adhesive applied to a preceding sheet in an unexpected portion in carrying a next sheet in the stacker section 40, preventing the adhesive from adhering to an unexpected position to enable sheets to be bonded in a predetermined position, enabling sheets to be staple-bound corresponding to use instead of bonding sheet, and further enabling two types of binding of bonding of sheets and staple binding to be performed with these schemes stored in a single apparatus frame.

5. The sheet processing apparatus as described in above-mentioned 4, where the staple binding unit 240 is disposed between the adhesion unit 50 and the folding processing section 80.

According to this configuration, since the staple binding unit 240 is disposed above the folding processing section 80, it is possible to actualize a compact apparatus with many sheet paths overlapping sheet paths of the adhesion unit 50.

6. The sheet processing apparatus as described in above-mentioned 4, where in binding sheets with the staple binding unit 240, the downstream end in the transport direction of a sheet is positioned in the retract path 47, whenever the sheet is carried in the stacker section 40.

According to this configuration, since the sheet upstream end with carry-in in the stacker section 40 completed is positioned on the retract path 47 side, it is possible to avoid a collision with the front end of the next sheet. Further, the retract path is also used for sheet retract in bonding with the adhesion unit 50, and the apparatus is thereby made simple.

7. The sheet processing apparatus as described in above-mentioned 6, where a retract shift amount to the retract path 47 in binding sheets with the adhesion unit 50 is larger than a retract shift amount to the retract path 47 in binding sheets with the staple binding unit 240.

According to this configuration, it is possible to reliably carry the application position of the adhesive of the preceding sheet in the retract path 47 (application retract position 100), and to prevent the adhesive from contacting the front end of the next sheet.

8. The sheet processing apparatus as described in above-mentioned 4, where the adhesion unit 50 is comprised of a transfer tape (hereinafter, adhesive tape AT) including the adhesive on a tape substrate, application of the adhesive to the sheet is performed by transferring the adhesive from the adhesive tape AT to the sheet, and a plurality of adhesive tapes AT is disposed in the sheet width direction.

According to this configuration, it is possible to provide the apparatus which readily performs application to the sheet with ease in handling of the adhesive 9. The sheet processing apparatus as described in above-mentioned 8, where transfer of the adhesive of the adhesive tape AT to the sheet is applied by pressing the adhesive tape AT to the sheet, and bonding of sheets is also performed by the pressing.

According to this configuration, it is possible to provide the apparatus that concurrently performs transfer bonding of the adhesive tape AT to the sheet and press-bonding of sheets by pressing the adhesive tape AT.

10. An image formation apparatus is comprised of an image formation section that forms an image on a sheet sequentially, and a sheet processing apparatus that performs predetermined processing on the sheet from the image formation section, where the sheet processing apparatus is provided with the configuration as described in any one of above-mentioned 1 to 9.

According to this configuration, it is possible to provide the apparatus for exhibiting the effect as described in each of above-mentioned items.

In addition, in the description of the above-mentioned Embodiment and the effects thereof, in each section of this Embodiment, the reference numeral is assigned to each component in the scope of claims to clarify the relationship therebetween.

Further, the present invention is not limited to the Embodiment as described previously, various modifications thereof are capable of being made without departing from the scope of the invention, and all technical matters included in the technical idea as described in the scope of the claims are subjects of the invention. The Embodiment as described previously shows preferable examples, a person skilled in the art is capable of achieving various kinds of alternate examples, modified examples, changed example and improved examples from the content disclosed in the present description, and these examples are included in the technical scope as described in the scope of the claims attached herewith.

This application claims priority from Japanese Patent Application No. 2014-194872 filed on Sep. 25, 2014 in Japan incorporated herein by reference.

What is claimed is:

1. A sheet processing apparatus for folding sheets after binding, comprising:

a stacker section adapted to collect sheets transported along a transport path;

a sheet regulation member adapted to regulate a sheet transported to the stacker section;

a retract path positioned on an upstream side of the stacker section to branch off from the transport path so as to enable a sheet carried in the stacker section to be transported in a direction opposite to a carry-in direction;

an adhesion unit positioned in a junction position of the transport path and the retract path to bond sheets by applying an adhesive;

a staple binding unit adapted to bind sheets collected in the stacker section with a staple; and a folding processing section adapted to fold sheets which are bonded in the adhesion unit or bound in the staple binding unit and collected in the stacker section, wherein the retract path is a path for retracting an application position of a preceding sheet with the adhesive applied, in carrying a next sheet in the stacker section, and the staple binding unit is disposed in the stacker section between the adhesion unit and the folding processing section.

2. The sheet processing apparatus according to claim 1, further comprising:

a deflecting guide for positioning a rear end in a transport direction of a sheet in the retract path whenever the sheet is carried in the stacker section, in binding sheets with the staple binding unit, wherein the deflecting guide guides the sheet to the retract path side in binding sheets with the adhesion unit.

3. The sheet processing apparatus according to claim 2, wherein the adhesion unit is comprised of a transfer tape including the adhesive on a tape substrate, application of the adhesive to the sheet is performed by pressing the transfer tape to the sheet so that the adhesive is transferred from the transfer tape to the sheet, and bonding of sheets is also performed by the pressing.

4. An image formation apparatus comprising:

an image formation section adapted to form an image on a sheet sequentially; and a sheet processing apparatus adapted to perform predetermined processing on the sheet from the image formation section, wherein the sheet processing apparatus is provided with a configuration according to claim 1.

5. A sheet processing apparatus for folding sheets after binding, comprising:

a transport path adapted to transport a sheet;

a stacker section adapted to collect sheets transported from the transport path;

a sheet regulation member adapted to regulate a sheet transported to the stacker section;

a retract path positioned on an upstream side of the stacker section to branch off from the transport path so as to enable a sheet carried in the stacker section to be transported in a direction opposite to a carry-in direction;

an adhesion unit provided in a junction position of the transport path and the retract path to bond sheets by applying an adhesive to a midpoint in a transport direction of the sheet;

a staple binding unit adapted to bind sheets collected in the stacker section at the midpoint in the transport direction of the sheets with a staple;

a folding processing section adapted to fold sheets which are bonded in the adhesion unit or bound in the staple binding unit and collected in the stacker section;

a control section adapted to control the sheet regulation member, the adhesion unit and the staple binding unit, wherein the control section controls to apply the adhesive to an application position of a preceding sheet transported from the transport path to the stacker section in binding sheets with the adhesion unit, carry in a next sheet after retracting the application position to the retract path, overlap the preceding sheet and the next sheet to shift, and then, apply the adhesive to the next sheet to form a bunch of sheets, and controls to bind sheets to prepare a bunch of sheets after all of the sheets to perform binding processing being carried in the staple binding unit, in binding the sheets with the staple binding unit.

6. The sheet processing apparatus according to claim 5, wherein the staple binding unit is disposed between the adhesion unit and the folding processing section.

7. The sheet processing apparatus according to claim 6, wherein in binding sheets with the staple binding unit, a rear end in the transport direction of a sheet is positioned in the retract path, whenever the sheet is carried in the stacker section.

8. The sheet processing apparatus according to claim 7, wherein a sheet shift amount to the retract path in binding sheets with the adhesion unit is larger than a sheet shift amount to the retract path in binding sheets with the staple binding unit.

9. The sheet processing apparatus according to claim 5, wherein the adhesion unit is comprised of a transfer tape including the adhesive on a tape substrate, application of the adhesive to the sheet is performed by transferring the adhesive from the transfer tape to the sheet, and a plurality of transfer tapes is disposed in a sheet width direction.

10. The sheet processing apparatus according to claim 9, wherein transfer of the adhesive of the transfer tape to the sheet is applied by pressing the transfer tape to the sheet, and bonding of sheets is also performed by the pressing.

* * * * *